US008876986B2

(12) United States Patent
Hata et al.

(10) Patent No.: US 8,876,986 B2
(45) Date of Patent: Nov. 4, 2014

(54) COLD-ROLLED STEEL SHEET

(75) Inventors: Hideo Hata, Kobe (JP); Toshio Murakami, Kobe (JP); Akira Ibano, Kobe (JP); Fumio Yuse, Kobe (JP); Junichiro Kinugasa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 326 days.

(21) Appl. No.: 13/257,639

(22) PCT Filed: Oct. 1, 2009

(86) PCT No.: PCT/JP2009/067172

§ 371 (c)(1),
(2), (4) Date: Sep. 20, 2011

(87) PCT Pub. No.: WO2010/109702

PCT Pub. Date: Sep. 30, 2010

(65) Prior Publication Data

US 2012/0009434 A1 Jan. 12, 2012

(30) Foreign Application Priority Data

Mar. 27, 2009 (JP) ..... 2009-079775

(51) Int. Cl.

| | |
|---|---|
| ***C22C 38/00*** | (2006.01) |
| ***C22C 38/08*** | (2006.01) |
| ***C22C 38/16*** | (2006.01) |
| ***C22C 38/02*** | (2006.01) |
| ***C22C 38/06*** | (2006.01) |
| ***C22C 38/04*** | (2006.01) |
| ***C22C 38/14*** | (2006.01) |
| ***C21D 6/00*** | (2006.01) |
| ***C21D 9/46*** | (2006.01) |
| ***C22C 38/12*** | (2006.01) |

(52) U.S. Cl.

CPC . *C21D 9/46* (2013.01); *C22C 38/14* (2013.01); *C22C 38/001* (2013.01); *C21D 6/008* (2013.01); *C22C 38/06* (2013.01); *C22C 38/002* (2013.01); *C21D 2211/005* (2013.01); *C22C 38/04* (2013.01); *C22C 38/02* (2013.01); *C22C 38/12* (2013.01); *C21D 2211/008* (2013.01)

USPC ..... 148/320; 148/331; 148/330; 148/332; 148/336; 420/83; 420/121; 420/119; 420/89; 420/117; 420/103; 420/120

(58) Field of Classification Search

USPC ..... 148/320, 661, 337, 330, 331, 332, 336; 420/117, 120, 677, 676, 681, 103, 83, 420/121, 119, 89

See application file for complete search history.

(56) References Cited

U.S. PATENT DOCUMENTS

| | | | | |
|---|---|---|---|---|
| 8,343,288 | B2 * | 1/2013 | Murakami et al. | 148/335 |
| 2008/0000555 | A1 * | 1/2008 | Nonaka et al. | 148/328 |
| 2009/0277547 | A1 | 11/2009 | Saito et al. | |
| 2010/0252147 | A1 | 10/2010 | Murakami et al. | |
| 2011/0005643 | A1 | 1/2011 | Murakami et al. | |

FOREIGN PATENT DOCUMENTS

| | | |
|---|---|---|
| JP | 8 311600 | 11/1996 |
| JP | 2005 213603 | 8/2005 |
| JP | 2006 207019 | 8/2006 |
| JP | 2007 138262 | 6/2007 |
| JP | 2009 215571 | 9/2009 |
| JP | 2009 215572 | 9/2009 |
| WO | WO 2006038708 A1 * | 4/2006 |
| WO | 2008 007785 | 1/2008 |

OTHER PUBLICATIONS

U.S. Appl. No. 13/634,614, filed Sep. 13, 2012, Hata, et al.
International Search Report and Written Opinion issued Jan. 12, 2010 in PCT/JP09/067172 filed Oct. 1, 2009.
U.S. Appl. No. 13/258,823, filed Sep. 22, 2011, Murakami et al.

* cited by examiner

*Primary Examiner* — Roy King
*Assistant Examiner* — Jenny Wu
(74) *Attorney, Agent, or Firm* — Oblon, Spivak, McClelland, Maier & Neustadt, L.L.P.

(57) ABSTRACT

Disclosed is a high-strength cold-rolled steel sheet having improved stretch-flange formability and excellent hydrogen embrittlement resistance. In addition to Fe, C, Si, Mn, P, S, N, and Al, the steel sheet contains V or at least one element of Nb, Ti and Zr. The contents of the at least one element of Nb, Ti and Zr, if present, satisfy the expression of [% C]−[% Nb]/92.9×12−[% Ti]/47.9×12−[% Zr]/91.2×12>0.03. The steel sheet has an area ratio of tempered martensite of 50% or more with ferrite as the remainder. The number of precipitates having a circle-equivalent diameter of 1 to 10 nm is 20 particles or more per 1 $\mu m^2$ of the tempered martensite. The number of precipitates containing V or the at least one element of Nb, Ti and Zr and having a circle-equivalent diameter of 20 nm or more is 10 particles or less per 1 $\mu m^2$ of the tempered martensite.

7 Claims, No Drawings

COLD-ROLLED STEEL SHEET

TECHNICAL FIELD

The present invention relates to cold-rolled steel sheets which are suitable typically as automobile parts. Specifically, the present invention relates to high-strength cold-rolled steel sheets which are highly resistant to hydrogen embrittlement and have excellent workability.

BACKGROUND ART

Cold-rolled steel sheets to be used in automobile parts such as framework parts require a high strength on the order of 980 MPa or more, so as to have satisfactory crash safety and to reduce fuel consumption due to reduction in body weight. Simultaneously with this, the cold-rolled steel sheets require excellent processability (workability) so as to be processed into framework parts having complicated shapes.

High-strength steels largely used in bolts, prestressed concrete wires, line pipes, and other uses, when having a tensile strength of 980 MPa or more, are widely known to suffer from hydrogen embrittlement (e.g., pickling embrittlement, plating brittleness, and delayed fracture) due to the intrusion of hydrogen into the steel. The delayed fracture is a phenomenon in which hydrogen generated in a high-strength steel due to a corrosive environment or atmosphere diffuses to defects such as dislocations, vacancies, and grain boundaries to embrittle the material steel and to thereby cause fracture upon the application of a stress. The delayed fracture has harmful effects on the metal material, resulting in low ductility and/or low toughness. Most of techniques for improving hydrogen-embrittlement resistance are adopted to steels used typically in bolts. For example, Non Patent literature (NPL) 1 describes that a steel, when having a metal structure mainly containing tempered martensite and further containing one or more elements showing resistance to temper softening (e.g., Cr, Mo, and V), effectively has improved delayed-fracture resistance. This technique suppresses fracture by precipitating alloy carbides and utilizing them as hydrogen trapping sites to allow the delayed fracture to shift from intergranular fracture to transgranular fracture (intragranular fracture). These findings are, however, to be adopted to medium-carbon steels but cannot be adopted as intact to thin steel sheets having low carbon contents, which require satisfactory weldability and workability.

Under these circumstances, the present applicants have developed an ultrahigh-strength thin steel sheet having satisfactory hydrogen-embrittlement resistance, which contains carbon (C) in a content of more than 0.25 up to 0.60 percent by mass, with the remainder including iron and inevitable impurities (PTL 1). In this ultrahigh-strength thin steel sheet, the metal structure after stretch forming with an elongation of 3% includes retained austenite in a content of, in terms of area percentage to the entire structure, 1% or more; bainitic ferrite and martensite in a total content of 80% or more; and ferrite and pearlite in a total content of 9% or less, while the average axis ratio (major axis/minor axis) of the retained austenite grains is 5 or more.

The thin steel sheet excels in strength, elongation, and hydrogen-embrittlement resistance. Even the thin steel sheet, however, is difficult to reliably attain a stretch flangeability at a demanded level (at least 70%, desirably 90%), which stretch flangeability has been more and more valued recently. This is because the retained austenite causes fracture to lower the stretch flangeability.

CITATION LIST

Patent Literature

PTL 1: Japanese Unexamined Patent Application Publication No. 2006-207019

Non Patent Literature

NPL 1: The Iron and Steel Institute of Japan, Advances in Delayed Fracture Solution, January 1997, pages 111-120

SUMMARY OF INVENTION

Technical Problem

Accordingly, an object of the present invention is to provide a high-strength cold-rolled steel sheet which has an improved stretch flangeability while reliably having satisfactory hydrogen-embrittlement resistance.

Solution to Problem

The present invention provides a cold-rolled steel sheet containing carbon (C) in a content of 0.03 to 0.30 percent by mass, silicon (Si) in a content of 3.0 percent by mass or less (inclusive of 0 percent by mass), manganese (Mn) in a content of more than 0.1 percent by mass but 2.8 percent by mass or less, phosphorus (P) in a content of 0.1 percent by mass or less, sulfur (S) in a content of 0.005 percent by mass or less, nitrogen (N) in a content of 0.01 percent by mass or less, and aluminum (Al) in a content of 0.01 to 0.50 percent by mass, and further containing vanadium (V) in a content of 0.001 to 1.00 percent by mass, or at least one element selected from the group consisting of niobium (Nb), titanium (Ti), and zirconium (Zr) in a total content of 0.01 percent by mass or more so as to satisfy a condition represented by following Expression 1, with the remainder including iron and inevitable impurities, in which the cold-rolled steel sheet has a structure including tempered martensite in a content of 50 percent by area or more (inclusive of 100 percent by area), with the remainder including ferrite, the number density of precipitates each having an equivalent circle diameter of 1 to 10 nm is 20 or more per 1 $\mu m^2$ of the tempered martensite, and the number density of precipitates each containing V or at least one element selected from the group consisting of Nb, Ti, and Zr and each having an equivalent circle diameter of 20 nm or more is 10 or less per 1 $\mu m^2$ of the tempered martensite:

$$[\%\ C]-[\%\ Nb]/92.9\times12-[\%\ Ti]/47.9\times12-[\%\ Zr]/91.2\times12>0.03 \quad \text{(Expression 1)}$$

wherein [% C], [% Nb], [% Ti], and [% Zr] represent contents (percent by mass) of C, Nb, Ti, and Zr, respectively.

In a preferred embodiment, the cold-rolled steel sheet according to the present invention contains at least one element selected from the group consisting of Nb, Ti, and Zr in a total content of 0.01 percent by mass or more so as to satisfy the condition represented by Expression 1, in which ferrite grains each surrounded by a high-angle boundary with a difference in orientation between two grains of 15° or more have an average grain size of 5 μm or less. In another preferred embodiment, the cold-rolled steel sheet contains V in a content of 0.001 to 0.20 percent by mass, in which the number density of precipitates each containing V and each having an equivalent circle diameter of 20 nm or more is 10 or less per 1 $\mu m^2$ of the tempered martensite.

The cold-rolled steel sheet according to the present invention preferably further contains at least one element selected from the group consisting of chromium (Cr) in a content of 0.01 to 1.0 percent by mass, molybdenum (Mo) in a content of 0.01 to 1.0 percent by mass, copper (Cu) in a content of 0.05 to 1.0 percent by mass, and nickel (Ni) in a content of 0.05 to 1.0 percent by mass.

The cold-rolled steel sheet according to the present invention preferably further contains boron (B) in a content of 0.0001 to 0.0050 percent by mass.

The cold-rolled steel sheet according to the present invention preferably further contains at least one element selected from the group consisting of calcium (Ca) in a content of 0.0005 to 0.01 percent by mass, magnesium (Mg) in a content of 0.0005 to 0.01 percent by mass, and a rare-earth element (REM) in a content of 0.0004 to 0.01 percent by mass.

In another preferred embodiment of the cold-rolled steel sheet according to the present invention, the number density of cementite grains each having an equivalent circle diameter of 0.02 μm or more but less than 0.1 μm is 10 or more per 1 $\mu m^2$ of the tempered martensite, and the number density of cementite grains each having an equivalent circle diameter of 0.1 μm or more is 3 or less per 1 $\mu m^2$ of the tempered martensite.

In still another embodiment, the cold-rolled steel sheet according to the present invention has a dislocation density in the entire structure of $1\times10^{16}$ to $1\times10^{16}$ $m^{-2}$, and has such a Si equivalent as to be defined according to following Expression 2 and to satisfy a condition represented by following Expression 3:

$$[\text{Si equivalent}]=[\%\ \text{Si}]+0.36[\%\ \text{Mn}]+7.56[\%\ \text{P}]+0.15[\%\ \text{Mo}]+0.36[\%\ \text{Cr}]+0.43[\%\ \text{Cu}] \quad \text{(Expression 2)}$$

$$[\text{Si equivalent}]\geq 4.0-5.3\times10^{-8}\sqrt{[\text{dislocation density}]} \quad \text{(Expression 3)}$$

Advantageous Effects of Invention

The present invention enables proper control of the area percentage of tempered martensite and suitable control of the distribution of precipitates containing V or at least one of Nb, Ti, and Zr precipitated in the tempered martensite in a tempered martensite single-phase structure or in a binary phase structure composed of ferrite and tempered martensite. This improves stretch flangeability while ensuring satisfactory hydrogen-embrittlement resistance to give a high-strength thin steel sheet which excels both in stretch flangeability and in hydrogen-embrittlement resistance.

DESCRIPTION OF EMBODIMENTS

The present inventors focused attention on a high-strength steel sheet having a single-phase structure of tempered martensite (hereinafter also simply referred to as "martensite") or a binary phase structure composed of ferrite and tempered martensite. The present inventors considered that the high-strength steel sheet may have more satisfactory stretch flangeability while ensuring satisfactory hydrogen-embrittlement resistance, by adding V or at least one selected from Nb, Ti, and Zr as an alloy element to the steel, and suitably controlling the sizes of carbide and carbonitride of V or the sizes of carbides and carbonitrides of at least one of Nb, Ti, and Zr, each of which significantly plays a role as a hydrogen trapping site, and introducing them into the martensite. Based on these, the present inventors made intensive investigations about how various factors affect the hydrogen-embrittlement resistance and stretch flangeability. Hereinafter such carbides and carbonitrides of vanadium, and carbides and carbonitrides of at least one of Nb, Ti, and Zr are also generically referred to as "precipitates containing vanadium or another specific element."

As a result, the present inventors have found that the steel sheet can have higher stretch flangeability while ensuring satisfactory hydrogen-embrittlement resistance by reducing the content of ferrite and allowing the precipitates containing vanadium or another specific element to have smaller sizes. The present invention has been made based on these findings.

[Structure of Inventive Steel Sheet]

Initially, a structure (metallographic structure) which features the steel sheet according to the present invention will be described below.

As has been described above, the steel sheet basically includes a single phase of tempered martensite, or a binary phase structure (ferrite and tempered martensite) and is particularly featured by the control of distribution of precipitates containing vanadium or another specific element in the tempered martensite.

<Tempered martensite: 50 percent by area or more (inclusive of 100 percent by area)>

The structure mainly contains tempered martensite, whereby prevents fracture at boundaries between ferrite and tempered martensite, and allows the steel sheet to have satisfactory stretch flangeability.

To exhibit the action effectively, the tempered martensite is contained in a content of 50 percent by area or more, preferably 60 percent by area or more, and more preferably 70 percent by area or more (inclusive of 100 percent by area). The remainder includes ferrite.

<Number density of precipitates each having an equivalent circle diameters of 1 to 10 nm: 20 or more per 1 $\mu m^2$ of the tempered martensite>

Fine precipitates containing vanadium or another specific element, when suitably dispersed in the microstructure, help the cold-rolled steel sheet to have higher hydrogen-embrittlement resistance and to ensure delayed-fracture resistance after processing, because the fine precipitates effectively act as hydrogen trapping sites. Specifically, fine precipitates containing vanadium and having large specific surface areas, when dispersed in a large amounts, contributes to the increase of hydrogen trapping sites; and the precipitates containing vanadium or another specific element, when being allowed to have smaller sizes, impart a coherence strain field to the matrix around the precipitates containing vanadium or another specific element. This improves the ability of the fine precipitates as hydrogen trapping sites and improves the hydrogen-embrittlement resistance, because hydrogen tends to concentrate in such a strain field. This condition is adopted not only to precipitates containing vanadium or another specific element but also to all precipitates, unlike the condition relating to precipitates each having an equivalent circle diameter of 20 nm or more. This is because, within the grain size range (equivalent circle diameter of 1 to 10 nm), there is substantially no precipitates containing none of V, Nb, Ti, and Zr.

To exhibit the above actions effectively, the number density of fine precipitates each having an equivalent circle diameter of 1 to 10 nm is 20 or more, preferably 50 or more, and more preferably 100 or more, per 1 $\mu m^2$ of the tempered martensite. The sizes (equivalent circle diameters) of the fine precipitates are preferably from 1 to 8 nm, and more preferably from 1 to 6 nm.

The lower limit of the equivalent circle diameters of the fine precipitates is specified to be 1 nm, because excessively fine precipitates, if having an equivalent circle diameter of less than 1 nm, do not so effectively act as hydrogen trapping sites.

<Number density of precipitates each containing V or at least one of Nb, Ti, and Zr and each having an equivalent circle diameter of 20 nm or more: 10 or less per 1 $\mu m^2$ of the tempered martensite>

Vanadium carbide (VC) and other precipitates containing vanadium, and niobium carbide (NbC), titanium carbide (TiC), zirconium carbide (ZrC) and other precipitates containing at least one of Nb, Ti, and Zr have much higher rigidity and critical shear stress than those of the matrix and are thereby resistant to deformation even when the surrounding matrix deforms. These precipitates, when each having a size of 20 nm or more, cause large strain at the interface between the matrix and the precipitates to thereby cause fracture. For this reason, the presence of coarse precipitates having a size of 20 nm or more in a large amount may impair the stretch flangeability. Accordingly, the stretch flangeability may be improved by controlling the number density of such coarse precipitates containing vanadium or another specific element.

To exhibit the action effectively, the coarse precipitates containing vanadium or another specific element and each having an equivalent circle diameter of 20 nm or more are controlled to be in a number density of 10 or less, preferably 5 or less, and more preferably 3 or less, per 1 $\mu m^2$ of the tempered martensite.

The steel sheet according to the present invention essentially has a structure satisfying the above conditions. The steel sheet, when containing at least one element selected from the group consisting of Nb, Ti, and Zr, preferably has a structure satisfying not only the essential conditions, but also the following preferred conditions.

<Average grain size of ferrite grains each surrounded by a high-angle boundary with a difference in orientation between two grains of 15° or more: 5 μm or less>

Effective ferrite having a smaller size prevents fatigue cracks, even if generated at the interface between the martensite and the ferrite, from transmitting into the ferrite grains. This helps the steel sheet to have improved stretch flangeability.

To exhibit the action effectively, ferrite grains each surrounded by a high-angle boundary with a difference in orientation between two grains of 15° or more are controlled to have an average grain size of 5 μm or less, and preferably 10 μm or less.

When the steel sheet contains not only at least one of Nb, Ti, and Zr but also V, the vanadium content is preferably from 0.001 to 0.20 percent by mass.

Vanadium (V) element acts as a hydrogen trapping site by being present as fine carbide and carbonitride in the steel and thereby also contributes to the improvement in hydrogen-embrittlement resistance, as with Nb, Ti, and Zr. Vanadium, if present in a content of less than 0.001 percent by mass, may not effectively improve the hydrogen-embrittlement resistance. In contrast, vanadium, if present in a content of more than 0.20 percent by mass when the steel sheet further contains at least one of Nb, Ti, and Zr, may be present as an undissolved component in the steel upon heating in annealing. This increases coarsely grown vanadium carbide or vanadium carbonitride and thereby impairs the stretch flangeability. When the steel sheet contains at least one of Nb, Ti, and Zr, the vanadium content is more preferably 0.01 percent by mass or more but less than 0.15 percent by mass, and particularly preferably 0.02 percent by mass or more but less than 0.12 percent by mass.

The steel sheet according to the present invention has a structure which preferably satisfies the following recommended metallographic condition (a) or (b) in addition to the essential metallographic conditions.

<(a) Number density of cementite grains each having an equivalent circle diameter 0.02 μm or more but less than 0.1 μm: 10 or more per 1 $\mu m^2$ of the tempered martensite; number density of cementite grains each having an equivalent circle diameter of 0.1 μm or more: 3 or less per 1 $\mu m^2$ of the tempered martensite>

The steel sheet may have both higher elongation and more satisfactory stretch flangeability by controlling the size and number density of cementite grains precipitated in martensite during tempering, in addition to controlling the dispersion of precipitates containing vanadium or another specific element. Specifically, suitably fine cementite grains, by being dispersed in a large amount in the martensite, work as dislocation-propagation sources and thereby contribute to the improvement of elongation. Thus, the work-hardening exponent is increased. In addition, coarse cementite grains, which cause fracture upon stretch flange deformation, are reduced in number, resulting in further improved stretch flangeability.

To exhibit the action effectively, the number density of suitably fine cementite grains each having an equivalent circle diameter of 0.02 μm or more but less than 0.1 μm is preferably controlled to be 10 or more, more preferably 15 or more, and particularly preferably 20 or more, per 1 $\mu m^2$ of the tempered martensite. In contrast, it is recommended that the number density of coarse cementite grains each having an equivalent circle diameter of 0.1 μm or more is reduced to be 3 or less, more preferably 2.5 or less, and particularly preferably 2 or less, per 1 $\mu m^2$ of the tempered martensite.

The lower limit of equivalent circle diameters of the suitably fine cementite grains is specified to be 0.02 μm, because finer cementite grains each having a size of less than this level, may not impart sufficient strain to the crystal structure of martensite and little contribute as dislocation-propagation sources.

<(b) Dislocation density in entire structure: $1\times10^{15}$ to $1\times10^{16}$ $m^{-2}$, [Si equivalent]≥$4.0-5.3\times10^{-8}\sqrt{[\text{dislocation density}]}$>

The steel sheet may have satisfactory elongation by controlling the density of dislocations introduced into the entire structure, in addition to controlling the dispersion of the precipitates containing vanadium or another specific element. By this, the steel sheet may simultaneously have a satisfactory yield strength as an important index for crash safety on which importance has been placed recently. Specifically, in a C—Si—Mn low-alloy steel having the above-specified chemical composition, the yield strength of the structure mainly containing martensite and having been tempered at a temperature of higher than 400° C. significantly depends on dislocation strengthening, out of four strengthening mechanisms (solid-solution strengthening, precipitation strengthening, grain refinement strengthening, and dislocation strengthening). Based on this, the present inventors have found that the dislocation density in the entire structure should be $1\times10^{15}$ $m^{-2}$ or more in order to ensure a demanded yield strength of 900 MPa or more.

Independently, the elongation has a significant negative correlation with the dislocation density during early stages of deformation. Based on this, the present inventors have found that the dislocation density should be controlled to be $1\times10^{16}$ $m^{-2}$ or less, in order to ensure a satisfactory elongation of 10% or more.

Accordingly, it is recommended that the steel sheet has a dislocation density in the entire structure of from $1\times10^{15}$ to $1\times10^{16}$ $m^{-2}$.

As is described above, there is an upper limit of the density of dislocations introducible into the entire structure so as to ensure an elongation of 10% or more. After further investigations, the present inventors have found that solid-solution strengthening, which is placed after dislocation strengthening in contribution to the yield strength, should be fully utilized to ensure such a high yield strength of 900 MPa or more.

Initially, the present inventors have introduced a Si equivalent represented by Expression 2, as an index for the level of solid-solution strengthening required to ensure the yield strength of 900 MPa or more. The Si equivalent is an index of solid-solution strengthening action determined by converting solid-solution strengthening actions of respective elements other than Si to Si contents (translated by Toshio Fujita et al.: Physical Metallurgy and the Design of Steels, Maruzen Co., Ltd, (1981), p. 8) while employing, as a standard, Si which is a representative element showing a solid-solution strengthening action, to give a formulation below.

$$[\text{Si equivalent}]=[\%\ \text{Si}]+0.36[\%\ \text{Mn}]+7.56[\%\ \text{P}]+0.15[\%\ \text{Mo}]+0.36[\%\ \text{Cr}]+0.43[\%\ \text{Cu}] \quad \text{(Expression 2)}$$

Next, the increment $\Delta\sigma$ of yield strength by dislocation strengthening is expressed as $\Delta\sigma\propto\sqrt{\rho}$ as a function of the dislocation density $\rho$ based on the Bailey-Hirsh relation (Koichi Nakajima et al.: "Material and Process", Vol. 17, p. 396-399 (2004)). Based on these, the present inventors have experimentally verified a quantitative relation between the yield strength increasing effect of the solid-solution strengthening and the yield strength increasing effect of the dislocation strengthening, and found that the steel sheet reliably has a yield strength of 900 MPa or more by satisfying following Expression 3.

$$[\text{Si equivalent}]\geq 4.0-5.3\times10^{-8}\sqrt{[\text{dislocation density}]} \quad \text{(Expression 3)}$$

Hereinafter the area percentage of tempered martensite, the size and number density of precipitates, the size of effective ferrite, size and number density of cementite grains, and the dislocation density will be described below.

[Method for Measuring Area Percentage of Martensite]

Each of steel sheets as specimens was mirror-polished, corroded with a 3% Nital solution (solution of nitric acid in alcohol) to expose the metal structure, and images in five view fields of each about 40 μm long and 30 μm wide were observed under a scanning electron microscope (SEM) at 2000-fold magnification. The images were analyzed, based on which a region containing no cementite was defined as ferrite, and the other residual region was defined as martensite, and the area percentage of martensite was calculated from the area ratio between the two regions.

[Method for Measuring Size and Number Density of Precipitates]

Initially, a thin film sample was prepared according to a thin foil technique or extraction replica technique, for the measurement of the size and number density of precipitates. This sample was observed in an area of 2 $\mu m^2$ or more under a field-emission transmission electron microscope (FE-TEM) at 100000-fold to 300000-fold magnification, and, based on the contrast of image, dark portions were marked as precipitates. The equivalent circle diameters of the respective marked precipitates were determined from their areas by calculation using an image analysis software, and the numbers of precipitates having specific sizes per unit area were counted.

However, the number of precipitates each having a size of 20 nm or more was counted only for precipitates that had been verified to contain V or at least one of Nb, Ti, and Zr by using an energy dispersive X-ray spectroscope (EDX) or an electron energy-loss spectroscope (EELS) attached to the FE-TEM.

[Method for Measuring Size and Number Density of Cementite Grains]

Initially, each of steel sheets as specimens was mirror-polished and corroded with picral (solution of picric acid in alcohol) to expose the metal structure for the measurement of the size and number density of cementite grains. Then an image was observed in a view field of 100 $m^2$ under a scanning electron microscope (SEM) at 10000-fold magnification for the analysis of the inner region of martensite, and based on the image contrast, whity portions were distinguished as cementite grains and marked. Using an image analysis software, the equivalent circle diameters of the respective marked cementite grains were determined based on their areas, and the number of cementite grains having predetermined sizes per unit area was counted.

[Method for Measuring Dislocation Density]

To measure the dislocation density, initially, such a specimen as to be measurable at a position of one-quarter depth of the thickness was prepared, and the surface of the specimen was coated with a silicon powder as a standard material. This was run through an X-ray diffractometer (supplied by Rigaku Corporation, RAD-RU300), by which an X-ray diffraction profile was obtained. The dislocation density was calculated based on the X-ray diffraction profile according to the analysis technique proposed by Koichi Nakajima et al. (Koichi Nakajima et al, "Material and Process", Vol. 17, p. 396-399 (2004)).

[Method for Measuring Size of Effective Ferrite]

The orientation of a high-angle boundary with a difference in orientation between two grains of 15° or more was measured on several view fields of 10000 $\mu mm^2$ using a transmission electron microscope (TEM) at 10000-fold magnification according to an electron backscatter diffraction (EBSD) technique. A ferrite surrounded by a high-angle boundary with a difference in crystal orientation (orientation difference angle of ferrite grain boundary) of 15° or more was defined as effective ferrite. The average grain size of effective ferrite grains was determined by measuring dimensions of a grain boundary with a difference in orientation of 15 degrees or more with an adjacent grain under a scanning electron microscope (SEM; JSM-5410 supplied by JEOL) at 5000-fold magnification with OIM (trade mark) supplied by TSL Solutions according to a section technique (see Japanese Unexamined Patent Application Publication No. 2005-133155, Paragraphs [0021]-[0022]).

Next, the chemical composition of the steel sheet according to the present invention will be described.

[C: 0.03 to 0.30 percent by mass]

Carbon (C) element affects the area percentage of martensite, affects the strength and stretch flangeability, and is important. In addition, carbon combines with V or at least one of Nb, Ti, and Zr to form precipitates containing vanadium or another specific element. For this reason, the balance between the carbon content and the vanadium content or the content of at least one of Nb, Ti, and Zr, if varied, affects behaviors, such as precipitation, disappearance, and coarsening, of the precipitates containing vanadium or another specific element during heat treatments and affects the hydrogen embrittlement resistance and stretch flangeability. The steel sheet, if having a carbon content of less than 0.03 percent by mass, may not have a satisfactory strength due to insufficient area percentage of martensite. In contrast, the steel sheet, if having a carbon content of more than 0.30 percent by mass, may not have satisfactory hydrogen embrittlement resistance, because precipitates containing vanadium or another specific element may become excessively stable upon heating in the annealing process and may fail to be fine precipitates. The lower limit of carbon content is preferably 0.05 percent by mass, more preferably 0.07 percent by mass, and furthermore preferably 0.08 percent by mass. The upper limit of the carbon content is preferably 0.25 percent by mass, and more preferably 0.20 percent by mass.

[Si: 3.0 percent by mass or less (inclusive of 0 percent by mass)]

Silicon (Si) element is useful as a solid-solution strengthening element and allows the steel sheet to have higher strength without impairing the elongation. Silicon, if present in a content of more than 3.0 percent by mass, may inhibit the formation of austenite during heating, and the resulting steel sheet may fail to have a satisfactory area percentage of martensite and to have satisfactory stretch flangeability. The Si content is preferably 2.5 percent by mass or less, more preferably 2.0 percent by mass or less, furthermore preferably 1.8 percent by mass or less, and particularly preferably 1.5 percent by mass or less (inclusive of 0 percent by mass).

[Mn: more than 0.1 percent by mass but 2.8 percent by mass or less]

Manganese (Mn) element increases the hardenability, ensures a satisfactory area percentage of martensite during rapid cooling after heating in annealing, thereby effectively increases the strength and the stretch flangeability, and is effective. Manganese, if present in a content of 0.1 percent by mass or less, may cause the formation of bainite during rapid cooling for quenching, may invite an insufficient area percentage of martensite, and this may cause the steel sheet to fail to ensure satisfactory strength and stretch flangeability. In contrast, manganese, if present in a content of more than 2.8 percent by mass, may cause austenite to remain even during quenching (cooling after heating in annealing), and may thereby cause the steel sheet to have insufficient stretch flangeability. The Mn content is preferably from 0.30 to 2.5 percent by mass, and more preferably from 0.50 to 2.2 percent by mass.

[P: 0.1 percent by mass or less]

Phosphorus (P) element is inevitably present as an impurity element and contributes to the increase of strength due to solid-solution strengthening. However, phosphorus segregates at a grain boundary of prior austenite, thereby embrittles the grain boundary, and causes the steel sheet to have inferior stretch flangeability. For these reasons, the phosphorus content is controlled to 0.1 percent by mass or less. The phosphorus content is preferably 0.05 percent by mass or less, and more preferably 0.03 percent by mass or less.

[S: 0.005 percent by mass or less]

Sulfur (S) element is also inevitably present as an impurity element, forms MnS inclusions, thereby causes cracks upon bore expanding, and causes the steel sheet to have insufficient stretch flangeability. For this reason, the sulfur content is controlled to 0.005 percent by mass or less. The sulfur content is more preferably 0.003 percent by mass or less.

[N: 0.01 percent by mass or less]

Nitrogen (N) element is also inevitably present as an impurity element and lowers the elongation and stretch flangeability due to strain aging. For this reason, the nitrogen content is preferably minimized, and is controlled to 0.01 percent by mass or less.

[Al: 0.01 to 0.50 percent by mass]

Aluminum (Al) element combines with nitrogen to form AlN, thereby reduces dissolved nitrogen causing strain aging and prevents the deterioration of stretch flangeability. In addition, this element contributes to the improvement of strength due to solid-solution strengthening. If the Al content is less than 0.01 percent by mass, dissolved nitrogen may remain in the steel and thereby cause strain aging, and the resulting steel sheet may fail to have satisfactory elongation and stretch flangeability. In contrast, aluminum, if present in a content of more than 0.50 percent by mass, may inhibit the formation of austenite during heating and may cause the steel sheet to fail to have a satisfactory area percentage of martensite and to have satisfactory stretch flangeability.

[V in a content of 0.001 to 1.00 percent by mass, or at least one of Nb, Ti, and Zr in a total content of 0.01 percent by mass or more so as to satisfy the condition: [% C]−[% Nb]/92.9×12−[% Ti]/47.9×12−[% Zr]/91.2×12>0.03]

(V: 0.001 to 1.00 percent by mass)

Vanadium (V) element accelerates the formation of iron oxide α-FeOOH, is present as fine carbides and carbonitrides in the steel, and thereby acts as a hydrogen trapping site. The iron oxide α-FeOOH is believed to be thermodynamically stable and to have a protecting action among rusts generated in the air. For these reasons, vanadium element is important for higher hydrogen-embrittlement resistance. Vanadium, if present in a content of less than 0.001 percent by mass, may not sufficiently effectively improve the hydrogen-embrittlement resistance. In contrast, vanadium, if present in a content of more than 1.00 percent by mass, may increase vanadium carbide or vanadium carbonitride and may cause the steel sheet to have inferior stretch flangeability. Such vanadium carbide or vanadium carbonitride is present as an undissolved component in the steel and grows to be coarse precipitates during heating in annealing. The vanadium content is preferably 0.01 percent by mass or more but less than 0.50 percent by mass, and more preferably 0.02 percent by mass or more but less than 0.30 percent by mass.

When the steel sheet contains both V and at least one of Nb, Ti, and Zr, the vanadium content is preferably 0.001 to 0.20 percent by mass, as is described above.

(At least one of Nb, Ti, and Zr in a total content of 0.01 percent by mass or more so as to satisfy the condition: [% C]−[% Nb]/92.9×12−[% Ti]/47.9×12−[% Zr]/91.2×12>0.03)

Niobium (Nb), titanium (Ti), and zirconium (Zr) elements are present as fine carbides and carbonitrides in the steel, thereby work as hydrogen trapping sites, and are important for higher hydrogen-embrittlement resistance. In addition, these elements are present as fine carbides/carbonitrides, act as grains that pin the growth of austenite during heating in annealing, and thereby contribute to refining of the effective ferrite. Nb, Ti, and Zr, if present in a total content of less than 0.01 percent by mass, may not sufficiently effectively improve the hydrogen-embrittlement resistance. In contrast, if the contents of these elements are such that [[% C]−[% Nb]/92.9×12−[% Ti]/47.9×12−[% Zr]/91.2×12] is equal to or less than 0.03, the amount of carbon to be dissolved in austenite during heating in annealing becomes insufficient, and the steel sheet may not have sufficient hardness derived from martensite. The total content of Nb, Ti, and Zr is preferably 0.02 percent by mass or more but less than 0.10 percent by mass, and more preferably 0.03 percent by mass or more but less than 0.10 percent by mass.

The steel for use in the present invention basically contains the components with the remainder being substantially iron and impurities. However, the steel may further contain any of the following allowable components within ranges not adversely affecting the operation of the present invention.

[At least one element selected from the group consisting of:

Cr in a content of 0.01 to 1.0 percent by mass,

Mo in a content of 0.01 to 1.0 percent by mass,

Cu in a content of 0.05 to 1.0 percent by mass, and

Ni in a content of 0.05 to 1.0 percent by mass]

These elements increase the hardenability and contribute to a satisfactory area percentage of martensite, and are thereby useful for higher strength and higher stretch flangeability. Of these elements, chromium (Cr) and molybdenum (Mo) form alloy carbides and carbonitrides which will act as hydrogen trapping sites during tempering, and copper (Cu) and nickel (Ni) accelerate the generation of α-FeOOH, as with vanadium. All the actions also help to improve the hydrogen-embrittlement resistance. Each of these elements, if added in a content of lower than the lower limit, may not effectively exhibit the actions. In contrast, Cr, Mo, and Cu, if each present in a content of more than 1.0 percent by mass, may cause martensite to be excessively hard; and Ni, if present in a content of more than 1.0 percent by mass, may cause austenite to remain even during quenching. This may cause the steel sheet to have insufficient stretch flangeability.

[B: 0.0001 to 0.0050 percent by mass]

Boron (B) element is present as a solid solution at the grain boundary of austenite in the steel, thereby helps the steel to have higher hardenability and a higher area percentage of martensite. Boron, if present in a content of less than 0.0001 percent by mass, may not effectively exhibit the action. In contrast, boron, if in an excessively high content of more than 0.0050 percent by mass, may form not a solid solution (dissolved boron) but $Fe_{23}(CB)_6$ and may fail to contribute to higher hardenability.

[At least one element selected from the group consisting of:

Ca: 0.0005 to 0.01 percent by mass,

Mg: 0.0005 to 0.01 percent by mass, and

REM: 0.0004 to 0.01 percent by mass]

These elements refine inclusions, thereby reduce origins of fracture, and are useful to improve the stretch flangeability. Calcium (Ca) and/or magnesium (Mg), if present in a content of less than 0.0005 percent by mass, or a rare-earth element (REM), if present in a content of less than 0.0004%, may not exhibit the action effectively. In contrast, each of these elements, if present in a content of more than 0.01 percent by mass, may contrarily cause coarsening of inclusions and may thereby impair the stretch flangeability.

As used herein the term "REM" refers to a rare-earth elements, namely, a Group 3A element of the periodic table.

Next, a preferred method for manufacturing the steel sheet according to the present invention will be illustrated below.

To manufacture the cold-rolled steel sheet according to the present invention, initially, a molten steel having the chemical composition is made and formed into a slab by ingot making or continuous casting, followed by hot rolling.

[Hot Rolling Conditions]

Hot rolling conditions may be set as follows. The hot-rolling heating temperature is 900° C. or higher when the steel contains vanadium; and is 1200° C. or higher when the steel contains at least one of Nb, Ti, and Zr. It is recommended that the slab is subjected to hot-rolling finish rolling at a temperature of 800° C. or higher when the steel contains vanadium, or at a temperature of 850° C. or higher when the steel contains at least one of Nb, Ti, and Zr; the hot-rolled steel is suitably cooled, and coiled at a temperature of 450° C. or lower.

Hot rolling, when performed under such temperature conditions, allows V or at least one of Nb, Ti, and Zr to be dissolved fully during the heating process, suppresses the precipitation of precipitates containing vanadium or another specific element during hot rolling and during coiling, and thereby prevents coarse precipitates containing vanadium or another specific element from remaining upon heating in annealing.

[Cold Rolling Conditions]

After the completion of hot rolling, the work is subjected to acid washing (pickling) and then to cold rolling. The cold rolling is preferably performed to a reduction ratio of about 30% or more.

After the cold rolling, the work is subsequently subjected to annealing and tempering.

[Annealing Conditions]

1) Steel Sheet Containing Vanadium:

When the steel contains vanadium, the annealing is preferably performed under such conditions that the work is heated at an annealing heating temperature of $[-9500/\{\log([\%\,C].[\%\,V])-6.72\}-273]$° C. or higher, and $[(Ac_1+Ac_3)/2]$ or higher but 1000° C. or lower and held at the temperature for a holding time of 20 to 3600 seconds; and the work is then rapidly cooled from the annealing heating temperature directly to a temperature of equal to or lower than the Ms point (martensite start point) at a cooling rate of 50° C./second or more. Alternatively, it is also preferred that the work is gradually cooled from the annealing heating temperature to a temperature (first cooling end temperature) of lower than the annealing heating temperature but equal to or higher than 600° C. at a cooling rate (first cooling rate) of 1° C./second or more but less than 50° C./second; and the work is then rapidly cooled to a temperature (second cooling end temperature) equal to or lower than the Ms point at a cooling rate (second cooling rate) of 50° C./second or more. As used herein the symbols [% C] and [% V] refer to a carbon content and a vanadium content (both percent by mass) in the steel, respectively.

[Annealing heating temperature Ta (° C.): $[-9500/\{\log([\%\,C].[\%\,V])-6.72\}-273]$° C. or higher and $[(Ac_1+Ac_3)/2]$ or higher but 1000° C. or lower, annealing holding time: 20 to 3600 seconds]

The annealing heating temperature Ta (° C.) is set to be equal to or higher than $[-9500/\{\log([\%\,C].[\%\,V])-6.72\}-273]$° C. This allows vanadium carbide and other analogous compounds to be fully dissolved during annealing heating and thereby reduces the number density of coarse precipitates containing vanadium and having a size of 20 nm or more; and this also enables full transformation into austenite during annealing heating, which austenite transforms into martensite during cooling performed after annealing heating, and thereby ensures an area percentage of martensite of 50% or more.

If the annealing heating temperature Ta (° C.) is lower than $[-9500/\{\log([\%\,C].[\%\,V])-6.72\}-273]$° C., namely, if log [% V] is less than $[[-9500/(Ta+273)]-\log[\%\,C]]$, undissolved vanadium carbide or other compounds may remain during annealing heating, these compounds may become coarse to increase origins of fracture upon stretch flange deformation, and this may impair the stretch flangeability, thus being undesirable. The relational expression: Ta (° C.)≥ $[-9500/\{\log([\%\,C].[\%\,V])-6.72\}-273]$° C. is determined by reading a linear plot indicating how the solubility product of vanadium and carbon [[V].[C]] varies depending on the temperature, given in Handbook of Iron and Steel (edited by The Iron and Steel Institute of Japan), 3rd Ed., Vol. I, page 412, Fig. 7.43), and modifying this so as to calculate a temperature at which vanadium is completely dissolved.

Annealing heating, if performed at a temperature Ta (° C.) of lower than $[(Ac_1+Ac_3)/2]$° C., may cause insufficient transformation into austenite during annealing heating, and the austenite in such an insufficient amount transforms into martensite in a smaller amount during subsequent cooling, and the resulting steel sheet may fail to have a satisfactory area percentage of martensite of 50% or more, thus being undesirable. In contrast, annealing heating, if performed at a temperature Ta (° C.) of higher than 1000° C., may cause the austenite structure to be coarse and may cause the steel sheet to have insufficient bendability or unsatisfactory toughness, and may cause deterioration of annealing facilities, thus being undesirable.

Annealing, if performed for an annealing holding time of shorter than 20 seconds, may not allow vanadium carbide or another compound to be dissolved completely; and, in contrast, the annealing, if performed for an annealing holding time of longer than 3600 seconds, may cause significantly poor productivity, thus being undesirable.

2) Steel Sheet Containing at Least One of Nb, Ti, and Zr:

When the steel contains at least one of Nb, Ti, and Zr, the annealing is preferably performed under such conditions that the work is heated to an annealing heating temperature satisfying following Expression 4 and being $[(Ac_1+Ac_3)/2]$ or higher but 1000° C. or lower, and held at the temperature for a holding time of 20 to 3600 seconds; and the work is then rapidly cooled from the annealing heating temperature directly to a temperature equal to or lower than the Ms point at a cooling rate of 50° C./second or more. Alternatively, it is also preferred that the work is slowly cooled from the annealing heating temperature to a temperature (first cooling end temperature) of lower than the annealing heating temperature but equal to or higher than 600° C. at a cooling rate (first cooling rate) of 1° C./second or more but less than 50° C./second; and the work is then rapidly cooled to a temperature (second cooling end temperature) equal to or lower than the Ms point at a cooling rate (second cooling rate) of 50° C./second or more.

[Math. 1]

$$Pf = \frac{\sqrt{\left(\begin{matrix}[\%\ C]/12\times55.9-\\ [\%\ Nb]/92.9\times55.9-\\ [\%\ Ti]/47.9\times55.9-\\ [\%\ Zr]/91.2\times55.9\end{matrix}\right)^2+4\left(\begin{matrix}10^{-9260/T+4.68}+\\ 10^{-9020/T+4.09}\end{matrix}\right)}}{2}-\frac{\left(\begin{matrix}[\%\ C]/12\times55.9-\\ [\%\ Nb]/92.9\times55.9-\\ [\%\ Ti]/47.9\times55.9-\\ [\%\ Zr]/91.2\times55.9\end{matrix}\right)}{2}>0.0010 \quad \text{Expression 4}$$

Wherein $T$ represents the annealing heating temperature [K]

[Annealing heating temperature: Pf>0.0010 and $[(Ac_1+Ac_3)/2]$ or higher but 1000° C. or lower, annealing holding time: 20 to 3600 seconds]

The annealing heating temperature is preferably set so that Pf be higher than 0.0010. This allows carbides and other compounds of at least one of Nb, Ti, and Zr to be dissolved completely during annealing heating, thereby reduces the number density of coarse precipitates containing vanadium and having a size of 20 nm or more. In addition, the configuration enables sufficient transformation into austenite during annealing heating and thereby allows the steel sheet to have a satisfactory area percentage of martensite of 50% or more, which martensite is transformed from austenite during the subsequent cooling.

The left-hand symbol Pf of Expression 4 is a parameter indicating the dissolution amounts (solid-solution amounts) of Nb, Ti, and Zr in annealing heating and is obtained from the expression expressing the thermodynamic behaviors of Nb, Ti, and Zr in precipitation and solid solution (see Handbook of Iron and Steel (edited by The Iron and Steel Institute of Japan), 3rd Ed, Vol. I: Fundamentals, p. 412). The annealing heating temperature, when set so that Pf be higher than 0.0010, ensures sufficient amounts of dissolved niobium and dissolved titanium.

Annealing heating, if performed at a temperature Ta (° C.) of lower than $[(Ac_1+Ac_3)/2]$° C., may cause insufficient transformation into austenite during annealing heating, and the austenite in such an insufficient amount transforms into martensite in a smaller amount during subsequent cooling, and the resulting steel sheet may fail to have a satisfactory area percentage of martensite of 50% or more, thus being undesirable. In contrast, annealing heating, if performed at a temperature Ta (° C.) of higher than 1000° C., may cause the austenite structure to be coarse and may cause the steel sheet to have insufficient bendability or unsatisfactory toughness, and may cause deterioration of annealing facilities, thus being undesirable.

Annealing, if performed for an annealing holding time of shorter than 20 seconds, may fail to allow carbides and other compounds of at least one of Nb, Ti, and Zr to be dissolved completely, and in contrast, annealing, if performed for an annealing holding time of longer than 3600 seconds, may cause significantly poor productivity, thus being undesirable.

The following annealing conditions are in common both to a steel containing vanadium and to a steel containing at least one of Nb, Ti, and Zr.

[Rapid cooling to a temperature of equal to or lower than the Ms point at a cooling rate of 50° C./second or more]

This suppresses the formation of ferrite and bainite structures from austenite during cooling and thereby gives a martensite structure.

Rapid cooling, if completed at a temperature higher than the Ms point or if performed at a cooling rate of less than 50° C./second, may cause the formation of bainite and this may prevent the steel sheet from having a satisfactory strength

[Slow cooling to a temperature lower than the heating temperature but 600° C. or higher at a cooling rate of 1° C./second or more but less than 50° C./second]

This gives a ferrite structure in an amount of less than 50 percent by area and thereby helps the steel sheet to have a higher elongation while maintaining satisfactory stretch flangeability.

Slow cooling, if performed to a temperature of lower than 600° C. or if performed at a cooling rate of less than 1° C./second, may not allow ferrite formation, and the steel sheet may fail to have a satisfactory strength and satisfactory stretch flangeability.

The above-described recommended conditions as hot rolling conditions and annealing conditions are in common to all steel sheets, regardless of their metallographic conditions.

However, recommended tempering conditions differ between steel sheets satisfying the essential metallographic conditions alone and those satisfying not only the essential metallographic conditions but also the recommended metallographic condition (a) or (b). Hereinafter these will be separately described below.

[Tempering Conditions for Steel Sheet Satisfying Essential Metallographic Conditions Alone]

1) Steel Sheet Containing Vanadium:

When the steel sheet contains vanadium and satisfies the essential metallographic conditions alone, tempering is preferably performed under such conditions that the steel sheet is heated from the temperature after the annealing cooling to a tempering heating temperature Tt (° C.) of 480° C. or higher and held at the temperature for a tempering holding time t (second) before cooling, wherein Tt and t satisfy the condition: $Pg=\exp[-13123/(Tt+273)]\times t<1.8\times10^{-5}$.

Heating should be performed to a temperature of 480° C. or higher in order to allow vanadium carbide or another compound to precipitate during tempering, and the relation between the heating temperature and the holding time should be suitably controlled in order to control the sizes of precipitates.

The parameter $Pg=\exp[-1.3123/(Tt+273)]\times t$ is a parameter for regulating the sizes of precipitates and is obtained by setting and simplifying the parameter on the basis of a precipitate grain growth model, described in Expression (4.18), p. 106, "Material Metallography", by Koichi Sugimoto, et al., published by Asakura Publishing Co., Ltd.

Tempering, if performed under such conditions that $Pg=\exp[-13123/(Tt+273)]\times t$ be equal to or higher than $1.8\times10^{-5}$, may cause precipitates to be coarse, this may cause coarse precipitates having a size of 20 nm or more to be present in an excessively large number, and the steel sheet may fail to have satisfactory stretch flangeability.

2) Steel Sheet Containing at Least One of Nb, Ti, and Zr:

When the steel sheet contains at least one of Nb, Ti, and Zr and satisfies the essential metallographic conditions alone, tempering is preferably performed under such conditions that the steel sheet is heated from the temperature after the annealing cooling to a tempering heating temperature Tt (° C.) of 480° C. or higher but lower than 600° C., held at the temperature for a tempering holding time t (second) before cooling, in which Tt and t satisfy the condition: $Pg=\exp[-13520/(Tt+273)]\times t<1.00\times10^{-5}$.

Tempering heating should be performed to a temperature of 480° C. or higher to allow carbides and other compounds of at least one of Nb, Ti, and Zr during tempering and the relation between the heating temperature and the holding time should be suitably controlled to regulate the sizes of such precipitates.

The parameter $Pg=\exp[-13520/(Tt+273)]\times t$ is a parameter for regulating the sizes of precipitates and is obtained by setting and simplifying the parameter on the basis of a precipitate grain growth model, described in Expression (4.18), p. 106, "Material Metallography", by Koichi Sugimoto, et al., published by Asakura Publishing Co., Ltd.

Tempering, if performed under such conditions that $Pg=\exp[-13520/(Tt+273)]\times t$ be equal to or more than $1.00\times10^{-5}$, may accelerate precipitates to be coarse, thereby give coarse precipitates having a size of 20 nm or more in an excessively large amount, and this may prevent the steel sheet from having satisfactory stretch flangeability.

[Tempering Conditions for Steel Sheet Satisfying not Only the Essential Metallographic Conditions but Also the Recommended Metallographic Condition (a)]

When the steel sheet satisfies not only the essential metallographic conditions but also the recommended metallographic condition (a), tempering is preferably performed under such conditions as to satisfy not only the [tempering conditions for steel sheet satisfying essential methallographic conditions alone] but also the following conditions, both in the case of a steel sheet containing vanadium and in the case of a steel sheet containing at least one of Nb, Ti, and Zr.

Specifically, the work is heated from the temperature after the annealing cooling to a first-stage tempering heating temperature of from 325° C. to 375° C. at an average heating rate of 5° C./second or more between 100° C. and 325° C. The work is held at the temperature for a first-stage tempering holding time of 50 seconds or longer, and is heated to a second-stage tempering heating temperature T of 400° C. or higher. The work is held at the temperature for a second-stage tempering holding time t (second) before cooling, in which T and t satisfy the condition: $3.2\times10^{-4}<P=\exp[-9649/(T+273)]\times t<1.2\times10^{-3}$. When the temperature T is varied during the second-stage tempering holding, following Expression 5 may be used.

[Math. 2]

$$P=\int_0^t \exp\left(-\frac{9649}{(T(t)+273)}\right)\cdot dt \qquad \text{Expression 5}$$

The work is held at a temperature around 350° C. in a temperature region where cementite precipitates from martensite at the highest rate, to precipitate cementite grains uniformly in a martensite structure. Subsequently, the work is heated to a higher temperature region and held therein, to allow the cementite grains to grow to a suitable size.

[Heating to a first-stage tempering heating temperature of 325° C. to 375° C. at an average heating rate of 5° C./second or more between 100° C. and 325° C.]

Heating, if performed to a first-stage tempering heating temperature of lower than 325° C. or higher than 375° C. or if performed at an average heating rate of less than 5° C./second between 100° C. and 325° C., may cause non-uniform precipitation of the cementite grains in martensite, so that the proportion of coarse cementite grains will be higher due to growth thereof during the subsequent second-stage heating and holding, resulting in insufficient stretch flangeability.

[Heating to a second-stage tempering heating temperature T of 400° C. or higher and holding for a second-stage tempering holding time t (second), so that T and t satisfy the condition: $3.2\times10^{-4}<P=\exp[-9649/(T+273)]\times t<1.2\times10^{-3}$]

The parameter $P=\exp[-9649/(T+273)]\times t$ is a parameter for specifying the sizes of cementite grains as precipitates, obtained by setting and simplifying the parameter on the basis of a precipitate grain growth model, described in expression (4.18), p. 106, "Material Metallography", by Koichi Sugimoto, et al., published by Asakura Publishing Co., Ltd.

Heating, if performed to a second-stage tempering heating-temperature T of lower than 400° C., may be performed for an excessively long second-stage tempering holding time t necessary for causing the cementite grains to grow to a satisfactory size.

Second-stage tempering, if performed under such a condition that the parameter $P=\exp[-9649/(T+273)]\times t$ be equal to or less than $3.2\times10^{-4}$, may not allow cementite grains to grow sufficiently and may not give suitably fine cementite grains in a sufficient number, resulting in insufficient elongation.

Second-stage tempering, if performed under such a condition that the parameter $P=\exp[-9649/(T+273)]\times t$ be equal to or more than $1.2\times10^{-3}$, may cause cementite grains to be coarse to give cementite grains having a size of 0.1 μm or more in an excessively large number, resulting in insufficient stretch flangeability.

[Tempering Conditions for Steel Sheet Satisfying not Only the Essential Metallographic Conditions but Also the Recommended Metallographic Condition (b)]

When the steel sheet satisfies not only the essential metallographic conditions but also the recommended metallographic condition (b), tempering preferably performed under such conditions as to satisfy not only the [tempering conditions for steel sheets satisfying essential metallographic conditions alone] but also the following conditions, both in the case of a steel sheet containing vanadium and in the case of a steel sheet containing at least one of Nb, Ti, and Zr.

Specifically, the work is heated from the temperature after the annealing cooling to a tempering heating temperature of 550° C. to 650° C. and held in the temperature range for a tempering holding time of 3 to 30 seconds before cooling.

In tempering, the dislocation density decreases with an increasing heating temperature and with an increasing holding time. The number density of fine precipitates having a size of 10 nm or less increases with an increasing holding time.

However, the decreasing rate of the dislocation density and the increasing rate of the number density of fine precipitates significantly differ from each other in temperature dependency and time dependency. Specifically, the decreasing rate of the dislocation density varies more significantly depending on the time than on the temperature, but the increasing rate of the number density of fine precipitates more significantly varies depending on the temperature than on the time.

For maintaining the two parameters, i.e., the dislocation density and the number density of fine precipitates, within suitable ranges, the following conditions are effective. Specifically, it is effective to carry out tempering for a holding time shorter than the tempering holding time for customary steels, in order to have a dislocation density higher than that of the customary steels. It is also effective to carry out tempering at a heating temperature higher than that for the customary steels, in order to give fine precipitates in a number density of 20 per 1 $\mu m^2$ or more even when the tempering is carried out for such a short holding time.

However, tempering, if performed at a temperature of higher than 650° C., may cause rapid decrease of dislocation density by processing even in a short time, resulting in insufficient dislocation density. Further, if the work is held for a long time of longer than 30 seconds, this may cause excessive decrease of the dislocation density, resulting in insufficient dislocation density, so that the steel sheet may have insufficient yield strength either. In contrast, tempering, if performed at a temperature lower than 550° C., or if performed for a holding time of shorter than 3 seconds, may not give fine precipitates in a sufficient amount and may thereby cause the steel sheet to have insufficient hydrogen-embrittlement resistance.

EXAMPLES

1) Example 1

Steel Sheets Containing Vanadium

Respective steels, each having a specific chemical composition given in Table 1, were melted and formed into ingots each 120 mm thick.

The ingots were hot-rolled to a thickness of 25 mm, and hot-rolled again to a thickness of 3 mm. The works were pickled, subsequently cold-rolled to a thickness of 1.2 mm, and thereby yielded steel sheets serving as specimens. Heat treatments under various conditions given in Tables 2 to 4 were applied to the steel sheets.

TABLE 1

| Steel | Chemical composition (% by mass) | | | | | | | | | | | |
|---|---|---|---|---|---|---|---|---|---|---|---|---|
| type | C | Si | Mn | P | S | Al | V | Cr | Mo | Cu | Ni | B |
| A | 0.14 | 1.24 | 2.00 | 0.010 | 0.002 | 0.021 | 0.00 | — | — | — | — | — |
| B | 0.14 | 1.26 | 2.02 | 0.010 | 0.002 | 0.021 | 0.03 | — | — | — | — | — |
| C | 0.14 | 1.22 | 2.09 | 0.010 | 0.002 | 0.020 | 0.10 | — | — | — | — | — |
| D | 0.15 | 1.22 | 2.03 | 0.010 | 0.002 | 0.021 | 0.21 | — | — | — | — | — |
| E | 0.14 | 1.25 | 2.08 | 0.010 | 0.002 | 0.021 | 1.22 | — | — | — | — | — |
| F | 0.15 | 0.02 | 2.01 | 0.010 | 0.002 | 0.021 | 0.11 | — | — | — | — | — |
| G | 0.14 | 1.86 | 2.03 | 0.010 | 0.002 | 0.020 | 0.11 | — | — | — | — | — |
| H | 0.14 | 3.35 | 2.07 | 0.010 | 0.002 | 0.020 | 0.11 | — | — | — | — | — |
| I | 0.01 | 1.21 | 2.08 | 0.010 | 0.002 | 0.021 | 0.11 | — | — | — | — | — |
| J | 0.12 | 1.25 | 2.01 | 0.010 | 0.002 | 0.020 | 0.11 | — | — | — | — | — |
| K | 0.28 | 1.22 | 2.06 | 0.010 | 0.002 | 0.020 | 0.10 | — | — | — | — | — |
| L | 0.52 | 1.24 | 2.09 | 0.010 | 0.002 | 0.020 | 0.10 | — | — | — | — | — |
| M | 0.15 | 1.21 | 0.10 | 0.010 | 0.002 | 0.020 | 0.12 | — | — | — | — | — |
| N | 0.14 | 1.21 | 1.01 | 0.010 | 0.002 | 0.021 | 0.12 | — | — | — | — | — |
| O | 0.14 | 1.22 | 1.50 | 0.010 | 0.002 | 0.021 | 0.11 | — | — | — | — | — |
| P | 0.15 | 1.25 | 2.44 | 0.010 | 0.002 | 0.021 | 0.11 | — | — | — | — | — |
| Q | 0.15 | 1.22 | 3.25 | 0.010 | 0.002 | 0.020 | 0.11 | — | — | — | — | — |
| R | 0.15 | 1.24 | 2.02 | 0.300 | 0.002 | 0.020 | 0.11 | — | — | — | — | — |
| S | 0.14 | 1.24 | 2.05 | 0.010 | 0.030 | 0.020 | 0.10 | — | — | — | — | — |
| T | 0.14 | 1.25 | 2.10 | 0.010 | 0.002 | 0.516 | 0.12 | — | — | — | — | — |
| U | 0.15 | 1.21 | 2.08 | 0.010 | 0.002 | 0.020 | 0.11 | 1.00 | — | — | — | — |
| V | 0.14 | 1.23 | 2.07 | 0.010 | 0.002 | 0.020 | 0.10 | — | 0.10 | — | — | — |
| W | 0.14 | 1.23 | 2.07 | 0.010 | 0.002 | 0.020 | 0.10 | — | — | 0.20 | 0.10 | — |
| X | 0.15 | 1.24 | 2.04 | 0.010 | 0.002 | 0.020 | 0.11 | — | — | — | — | 0.0010 |
| Y | 0.14 | 1.21 | 2.09 | 0.010 | 0.002 | 0.021 | 0.12 | — | — | — | — | — |

| Steel | Chemical composition (% by mass) | | | | Ac1 | Ac3 | (Ac1 + Ac3)/2 | VC melting tempera- |
|---|---|---|---|---|---|---|---|---|
| type | Ca | Mg | N | REM | (° C.) | (° C.) | (° C.) | ture (° C.) |
| A | — | — | 0.0042 | — | 738 | 889 | 814 | — |
| B | — | — | 0.0041 | — | 739 | 890 | 814 | 771 |
| C | — | — | 0.0047 | — | 738 | 889 | 813 | 835 |
| D | — | — | 0.0043 | — | 740 | 886 | 813 | 882 |
| E | — | — | 0.0047 | — | 758 | 890 | 824 | 996 |
| F | 0.0004 | — | 0.0045 | — | 704 | 832 | 768 | 844 |
| G | 0.0008 | — | 0.0047 | — | 757 | 917 | 837 | 840 |

TABLE 1-continued

| | | | | | | | | |
|---|---|---|---|---|---|---|---|---|
| H | 0.0008 | — | 0.0043 | — | 800 | 984 | 892 | 840 |
| I | 0.0007 | — | 0.0043 | — | 738 | 944 | 841 | 709 |
| J | 0.0005 | — | 0.0042 | — | 740 | 896 | 818 | 832 |
| K | 0.0008 | — | 0.0045 | — | 738 | 857 | 798 | 875 |
| L | 0.0009 | — | 0.0041 | — | 738 | 819 | 779 | 914 |
| M | 0.0006 | — | 0.0041 | — | 759 | 885 | 822 | 849 |
| N | 0.0009 | — | 0.0046 | — | 749 | 888 | 819 | 845 |
| O | 0.0009 | — | 0.0044 | — | 744 | 889 | 816 | 840 |
| P | 0.0007 | — | 0.0040 | — | 735 | 887 | 811 | 844 |
| Q | 0.0008 | — | 0.0042 | — | 726 | 886 | 806 | 844 |
| R | 0.0007 | — | 0.0045 | — | 739 | 887 | 813 | 844 |
| S | 0.0005 | — | 0.0041 | — | 739 | 889 | 814 | 835 |
| T | 0.0006 | — | 0.0045 | — | 739 | 890 | 814 | 845 |
| U | 0.0007 | — | 0.0047 | — | 738 | 885 | 812 | 844 |
| V | 0.0004 | — | 0.0041 | — | 738 | 892 | 815 | 835 |
| W | 0.0005 | — | 0.0043 | — | 737 | 888 | 812 | 835 |
| X | — | 0.0005 | 0.0045 | — | 739 | 887 | 813 | 844 |
| Y | — | — | 0.0042 | 0.0004 | 738 | 888 | 813 | 845 |

TABLE 2

(Number 1)

| | Hot rolling conditions | | | Annealing conditions | | | | | | Tempering conditions | | |
|---|---|---|---|---|---|---|---|---|---|---|---|---|
| Heat treatment number | Heating temperature (° C.) | Finish rolling temperature (° C.) | Coiling temperature (° C.) | Heating temperature (° C.) | Holding time (sec) | First cooling rate (° C./sec) | First cooling end temperature (° C.) | Second cooling rate (° C./sec) | Second cooling end temperature (° C.) | Heating temperature (° C.) | Holding time (sec) | Parameter: Pg |
| a | 1200 | 920 | 400 | 900 | 120 | 10 | 675 | 200 | 20 | 500 | 180 | $0.76 \times 10^{-5}$ |
| b | 1200 | 920 | 600 | 900 | 120 | 10 | 675 | 200 | 20 | 500 | 180 | $0.76 \times 10^{-5}$ |
| c | 1200 | 920 | 400 | 820 | 120 | 10 | 675 | 200 | 20 | 500 | 180 | $0.76 \times 10^{-5}$ |
| d | 1200 | 920 | 400 | 900 | 120 | 0.2 | 675 | 200 | 20 | 500 | 180 | $0.76 \times 10^{-5}$ |
| e | 1200 | 920 | 400 | 900 | 120 | 10 | 500 | 200 | 20 | 500 | 180 | $0.76 \times 10^{-5}$ |
| f | 1200 | 920 | 400 | 900 | 120 | 10 | 675 | 20 | 350 | 500 | 180 | $0.76 \times 10^{-5}$ |
| g | 1200 | 920 | 400 | 900 | 120 | — | — | 200 | 20 | 475 | 180 | $0.43 \times 10^{-5}$ |
| h | 1200 | 920 | 400 | 900 | 120 | 10 | 675 | 200 | 20 | 400 | 180 | $0.06 \times 10^{-5}$ |
| i | 1200 | 920 | 400 | 900 | 120 | 10 | 675 | 200 | 20 | 500 | 600 | $2.54 \times 10^{-5}$ |
| j | 1200 | 920 | 400 | 900 | 120 | 10 | 675 | 200 | 20 | 500 | 30 | $0.13 \times 10^{-5}$ |

TABLE 3

(Number 2)

| | Hot rolling conditions | | | Annealing conditions | | | | | |
|---|---|---|---|---|---|---|---|---|---|
| Heat treatment number | Heating temperature (° C.) | Finish rolling temperature (° C.) | Coiling temperature (° C.) | Heating temperature (° C.) | Holding time (sec) | First cooling rate (° C./sec) | First cooling end temperature (° C.) | Second cooling rate (° C./sec) | Second cooling end temperature (° C.) |
| a-1 | 1200 | 920 | 400 | 900 | 120 | 20 | 675 | 200 | 20 |
| b-1 | 1200 | 920 | 400 | 900 | 120 | 20 | 675 | 200 | 20 |
| c-1 | 1200 | 920 | 400 | 900 | 120 | 20 | 675 | 200 | 20 |
| d-1 | 1200 | 920 | 400 | 900 | 120 | 20 | 675 | 200 | 20 |
| e-1 | 1200 | 920 | 400 | 900 | 120 | 20 | 675 | 200 | 20 |

| | Tempering conditions | | | | | | |
|---|---|---|---|---|---|---|---|
| Heat treatment number | Average heating rate (° C./sec) | First-stage heating temperature (° C.) | First-stage holding time (sec) | Second-stage heating temperature (° C.) | Second-stage holding time (sec) | Parameter: P | Parameter: Pg |
| a-1 | 20 | 350 | 60 | 500 | 180 | $6.9 \times 10^{-4}$ | $0.76 \times 10^{-5}$ |
| b-1 | 20 | 200 | 60 | 500 | 180 | $6.9 \times 10^{-4}$ | $0.76 \times 10^{5}$ |
| c-1 | 20 | 450 | 60 | 500 | 180 | $6.9 \times 10^{-4}$ | $0.76 \times 10^{-5}$ |
| d-1 | 20 | 350 | 60 | 400 | 180 | $1.1 \times 10^{-4}$ | $0.062 \times 10^{-5}$ |
| e-1 | 20 | 350 | 60 | 600 | 180 | $2.9 \times 10^{-3}$ | $5.3 \times 10^{-5}$ |

TABLE 4

(Number 3)

| | Hot rolling conditions | | | Annealing conditions | | | | | | Tempering conditions | | |
|---|---|---|---|---|---|---|---|---|---|---|---|---|
| Heat treatment number | Heating temperature (° C.) | Finish rolling temperature (° C.) | Coiling temperature (° C.) | Heating temperature (° C.) | Holding time (sec) | First cooling rate (° C./sec) | First cooling end temperature (° C.) | Second cooling rate (° C./sec) | Second cooling end temperature (° C.) | Heating temperature (° C.) | Holding time (sec) | Parameter: Pg |
| a-2 | 1200 | 920 | 400 | 900 | 120 | 20 | 675 | 200 | 20 | 600 | 15 | $0.44 \times 10^{-5}$ |
| b-2 | 1200 | 920 | 400 | 900 | 120 | 20 | 675 | 200 | 20 | 600 | 1 | $0.03 \times 10^{-5}$ |
| c-2 | 1200 | 920 | 400 | 900 | 120 | 20 | 675 | 200 | 20 | 600 | 180 | $5.33 \times 10^{-5}$ |
| d-2 | 1200 | 920 | 400 | 900 | 120 | 20 | 675 | 200 | 20 | 700 | 15 | $2.08 \times 10^{-5}$ |
| e-2 | 1200 | 920 | 400 | 900 | 120 | 20 | 675 | 200 | 20 | 600 | 5 | $0.15 \times 10^{-5}$ |

The respective steel sheets after the heat treatment were subjected to quantitative analysis of their structures according to the measuring methods described above. Specifically, the area percentage of martensite, and the size and number (number density) of precipitates were measured on all the steel sheets after the heat treatments under the heat treatment conditions given in Tables 2 to 4. Independently, the size and number (number density) of cementite grains were measured only on the steel sheets undergone the heat treatments Nos. a-1 to e-1 given in Table 3. The dislocation density was measured only on the steel sheets undergone the heat treatments Nos. a-2 to e-2 given in Table 4.

Tensile strength TS, elongation El, and stretch flangeability λ were measured on the respective steel sheets, for the evaluation of mechanical properties. In addition, hydrogen embrittlement risk index was measured on the steel sheets, for the evaluation of hydrogen-embrittlement resistance.

The tensile strength TS and the elongation El were measured by preparing a specimen referred to as No. 5 specimen in JIS Z 2201, with its long axis oriented in a direction perpendicular to the rolling direction, and making measurements on the specimen in accordance with MS Z 2241.

The stretch flangeability λ was determined by conducting a hole expanding test according to Iron and Steel Federation Specification JFST 1001 and measuring a bore expansion ratio as the stretch flangeability.

For the evaluation of the hydrogen embrittlement risk index, a flat specimen 1.2 mm thick was subjected to a slow strain rate test (SSRT: Slow Strain Rate Technique) at a strain rate (tensile speed) of $1\times10^{-4}$/s, to determine the hydrogen embrittlement risk index (%) defined by the following expression:

$$\text{Hydrogen embrittlement risk index (\%)}=100\times(1-E_1/E_0)$$

In the expression, $E_0$ represents the elongation before rupture of a steel specimen containing substantially no hydrogen; and $E_1$ represents the elongation before rupture of a steel specimen having been charged with hydrogen electrochemically in sulfuric acid. Hydrogen charging was carried out by immersing the steel specimen in a mixed solution of $H_2SO_4$ (0.5 mol/L) and KSCN (0.01 mol/L) and supplying a constant current (100 A/m$^2$) at room temperature.

A steel sheet having a hydrogen embrittlement risk index of more than 15% may undergo hydrogen embrittlement during use. In the present invention, therefore, steel sheets having hydrogen embrittlement risk index of 15% or less were evaluated to have satisfactory hydrogen embrittlement resistance.

Measured data of the mechanical properties and hydrogen-embrittlement resistance are shown in Tables 5 to 7.

TABLE 5

(Number 1)

| Steel No. | Steel type | Heat treatment number | Martensite area percentage VM (%) | Ferrite area percentage VF (%) | Area percentage of other structures (%) | Number density of precipitates of 1-10 nm (number/μm$^2$) | Number density of vanadium-containing precipitates of 20 nm or more (number/μm$^2$) | TS (MPa) | λ (%) | Hydrogen embrittlement risk index (%) | Evaluation |
|---|---|---|---|---|---|---|---|---|---|---|---|
| 1 | A | a | 92 | 8 | 0 | 0 | 0.0 | 1023 | 79 | 18.4 | X |
| 2 | B | a | 91 | 9 | 0 | 107 | 0.7 | 1028 | 76 | 10.4 | ○ |
| 3 | C | a | 94 | 6 | 0 | 330 | 0.6 | 1048 | 77 | 8.3 | ○ |
| 4 | D | a | 91 | 9 | 0 | 543 | 6.0 | 1061 | 71 | 6.7 | ○ |
| 5 | E | a | 94 | 6 | 0 | 924 | 60.0 | 1038 | 34 | 4.4 | X |
| 6 | F | a | 94 | 6 | 0 | 537 | 0.7 | 1012 | 81 | 6.8 | ○ |
| 7 | G | a | 91 | 9 | 0 | 539 | 0.6 | 1049 | 83 | 6.6 | ○ |
| 8 | H | a | 42 | 58 | 0 | 501 | 0.6 | 901 | 62 | 6.6 | X |
| 9 | I | a | 11 | 89 | 0 | 543 | 0.6 | 609 | 80 | 6.3 | X |
| 10 | J | a | 91 | 9 | 0 | 546 | 0.8 | 1026 | 91 | 6.8 | ○ |
| 11 | K | a | 100 | 0 | 0 | 538 | 3.4 | 1203 | 98 | 6.9 | ○ |
| 12 | L | a | 100 | 0 | 0 | 520 | 31.3 | 1305 | 38 | 6.7 | X |
| 13 | M | a | 44 | 56 | 0 | 528 | 0.5 | 710 | 64 | 6.9 | X |
| 14 | N | a | 70 | 30 | 0 | 509 | 0.6 | 981 | 70 | 6.8 | ○ |
| 15 | O | a | 82 | 20 | 0 | 533 | 0.6 | 1003 | 83 | 6.6 | ○ |
| 16 | P | a | 100 | 0 | 0 | 508 | 0.7 | 1044 | 86 | 6.1 | ○ |
| 17 | Q | a | 84 | 0 | 16 | 545 | 0.5 | 1107 | 32 | 40.4 | X |
| 18 | R | a | 94 | 6 | 0 | 512 | 0.6 | 1027 | 89 | 6.6 | ○ |
| 19 | S | a | 93 | 7 | 0 | 542 | 0.6 | 1021 | 86 | 6.4 | ○ |
| 20 | T | a | 40 | 60 | 0 | 528 | 0.7 | 802 | 50 | 6.1 | X |

TABLE 5-continued (Number 1)

| Steel No. | Steel type | Heat treatment number | Martensite area percentage VM (%) | Ferrite area percentage VF (%) | Area percentage of other structures (%) | Number density of precipitates of 1-10 nm (number/μm$^2$) | Number density of vanadium-containing precipitates of 20 nm or more (number/μm$^2$) | TS (MPa) | λ (%) | Hydrogen embrittlement risk index (%) | Evaluation |
|---|---|---|---|---|---|---|---|---|---|---|---|
| 21 | U | a | 100 | 0 | 0 | 811 | 0.8 | 1059 | 97 | 3.4 | ○ |
| 22 | V | a | 100 | 0 | 0 | 844 | 0.7 | 1057 | 98 | 3.6 | ○ |
| 23 | W | a | 100 | 0 | 0 | 522 | 0.5 | 1051 | 96 | 2.1 | ○ |
| 24 | X | a | 100 | 0 | 0 | 547 | 0.6 | 1025 | 98 | 6.0 | ○ |
| 25 | Y | a | 100 | 0 | 0 | 518 | 0.6 | 1022 | 99 | 7.0 | ○ |
| 26 | J | b | 91 | 9 | 0 | 408 | 17.5 | 1003 | 58 | 6.9 | X |
| 27 | J | c | 45 | 55 | 0 | 510 | 0.8 | 804 | 68 | 6.4 | X |
| 28 | J | d | 34 | 66 | 0 | 536 | 0.5 | 708 | 66 | 6.2 | X |
| 29 | J | e | 44 | 15 | 41 | 543 | 0.7 | 700 | 44 | 6.2 | X |
| 30 | J | f | 100 | 0 | 0 | 502 | 0.6 | 1192 | 97 | 6.2 | ○ |
| 31 | J | g | 94 | 6 | 0 | 0 | 0.0 | 1214 | 78 | 20.5 | X |
| 32 | J | h | 94 | 6 | 0 | 342 | 18.6 | 1003 | 37 | 12.9 | X |
| 33 | J | j | 94 | 6 | 0 | 200 | 0.5 | 1298 | 81 | 9.3 | ○ |
| 34 | K | j | 100 | 0 | 0 | 360 | 1.0 | 1510 | 75 | 11.0 | ○ |

○: TS ≥ 980 MPa, λ ≥ 70%, hydrogen embrittlement risk index ≤ 15%
X: TS < 980 MPa or λ < 70% or hydrogen embrittlement risk index >15%

TABLE 6

(Number 2)

| Steel No. | Steel type | Heat treatment number | Martensite area percentage VM (%) | Ferrite area percentage VF (%) | Area percentage of other structures (%) | Number density of precipitates of 1-10 nm (number/μm$^2$) | Number density of vanadium-containing precipitates of 20 nm or more (number/μm$^2$) | Number density of cementite grains of 0.1 μm or more (number/μm$^2$) |
|---|---|---|---|---|---|---|---|---|
| 33 | J | a | 91 | 9 | 0 | 546 | 0.8 | 3.1 |
| 34 | J | a-1 | 91 | 9 | 0 | 511 | 0.6 | 1.1 |
| 35 | J | b-1 | 91 | 9 | 0 | 537 | 0.6 | 6.0 |
| 36 | J | c-1 | 91 | 9 | 0 | 549 | 0.8 | 5.3 |
| 37 | J | d-1 | 91 | 9 | 0 | 0 | 0.0 | 1.3 |
| 38 | J | e-1 | 91 | 9 | 0 | 320 | 14.2 | 7.3 |
| 39 | G | a | 91 | 9 | 0 | 539 | 0.6 | 5.2 |
| 40 | G | a-1 | 91 | 9 | 0 | 544 | 0.8 | 1.7 |
| 41 | O | a | 82 | 20 | 0 | 533 | 0.6 | 5.3 |
| 42 | O | a-1 | 82 | 20 | 0 | 545 | 0.6 | 1.7 |
| 43 | U | a | 100 | 0 | 0 | 811 | 0.8 | 5.1 |
| 44 | U | a-1 | 100 | 0 | 0 | 888 | 0.7 | 1.8 |
| 45 | W | a | 100 | 0 | 0 | 522 | 0.5 | 5.2 |
| 46 | W | a-1 | 100 | 0 | 0 | 838 | 0.7 | 1.6 |

| Steel No. | Number density of cementite grains of 0.02 μm or more but less than 0.1 μm (number/μm$^2$) | TS (MPa) | El (%) | λ (%) | Hydrogen embrittlement risk index (%) | Evaluation |
|---|---|---|---|---|---|---|
| 33 | 15.8 | 1026 | 11.6 | 91 | 6.8 | ○ |
| 34 | 15.4 | 1021 | 11.7 | 111 | 6.8 | ◎ |
| 35 | 15.3 | 1023 | 11.4 | 83 | 6.8 | ○ |
| 36 | 15.9 | 1026 | 12.0 | 64 | 6.8 | X |
| 37 | 7.4 | 1156 | 8.7 | 95 | 24.0 | X |
| 38 | 29.0 | 927 | 14.6 | 74 | 3.0 | X |
| 39 | 15.6 | 1049 | 11.8 | 83 | 6.6 | ○ |
| 40 | 15.1 | 1045 | 11.6 | 101 | 6.0 | ◎ |
| 41 | 15.9 | 1003 | 12.9 | 83 | 6.6 | ○ |
| 42 | 15.5 | 1007 | 12.7 | 104 | 6.0 | ◎ |
| 43 | 15.4 | 1059 | 12.9 | 97 | 3.4 | ○ |
| 44 | 15.7 | 1060 | 12.2 | 117 | 3.0 | ◎ |
| 45 | 15.3 | 1051 | 11.9 | 96 | 2.1 | ○ |
| 46 | 15.6 | 1052 | 11.7 | 116 | 2.0 | ◎ |

◎: TS ≥ 980 MPa, El ≥ 10%, λ ≥ 90%, hydrogen embrittlement risk index ≤ 15%
○: TS ≥ 980 MPa, λ ≥ 70%, hydrogen embrittlement risk index ≤ 15%
X: TS < 980 MPa or λ < 70% or hydrogen embrittlement risk index >15%

TABLE 7

(Number 3)

| Steel No. | Steel type | Heat treatment number | Martensite area percentage VM (%) | Ferrite area percentage VF (%) | Area percentage of other structures (%) | Number density of precipitates of 1-10 nm (number/$\mu m^2$) | Number density of vanadium-containing precipitates of 20 nm or more (number/$\mu m^2$) | Dislocation density $\rho$ ($10^{15} m^{-2}$) |
|---|---|---|---|---|---|---|---|---|
| 47 | J | a | 91 | 9 | 0 | 546 | 0.8 | 0.5 |
| 48 | J | a-2 | 93 | 7 | 0 | 584 | 0.5 | 1.6 |
| 49 | J | b-2 | 93 | 7 | 0 | 0 | 0.0 | 12 |
| 50 | J | c-2 | 95 | 5 | 0 | 547 | 26.8 | 0.4 |
| 51 | J | d-2 | 93 | 7 | 0 | 434 | 44.9 | 0.2 |
| 52 | G | a | 91 | 9 | 0 | 539 | 0.6 | 0.5 |
| 53 | G | a-2 | 90 | 10 | 0 | 593 | 0.4 | 1.8 |
| 54 | U | a | 100 | 0 | 0 | 811 | 0.8 | 0.6 |
| 55 | U | a-2 | 100 | 0 | 0 | 927 | 0.4 | 1.8 |
| 56 | W | a | 100 | 0 | 0 | 522 | 0.5 | 0.6 |
| 57 | W | a-2 | 100 | 0 | 0 | 561 | 0.4 | 1.8 |
| 58 | J | e-2 | 93 | 7 | 0 | 600 | 0.3 | 5.0 |
| 59 | K | e-2 | 100 | 0 | 0 | 700 | 0.5 | 6.0 |

| Steel No. | Si equivalent (% by mass) | $4.0-5.3 \times 10^{-8} \sqrt{\rho}$ ($m^{-1}$) | YP (MPa) | TS (MPa) | El (%) | $\lambda$ (%) | Hydrogen embrittlement risk index (%) | Evaluation |
|---|---|---|---|---|---|---|---|---|
| 47 | 2.0 | 2.8 | 840 | 1026 | 12.0 | 91 | 6.8 | ○ |
| 48 | 2.0 | 1.9 | 986 | 1026 | 13.3 | 121 | 5.0 | ◎ |
| 49 | 2.0 | 0.4 | 1323 | 1380 | 6.1 | 82 | 32.0 | X |
| 50 | 2.0 | 2.9 | 825 | 966 | 14.4 | 61 | 4.0 | X |
| 51 | 2.0 | 3.3 | 789 | 852 | 15.1 | 52 | 2.0 | X |
| 52 | 2.7 | 2.8 | 890 | 1049 | 12.0 | 83 | 6.6 | ○ |
| 53 | 2.7 | 1.8 | 990 | 1049 | 12.0 | 100 | 6.0 | ◎ |
| 54 | 2.1 | 2.7 | 850 | 1059 | 12.0 | 97 | 3.4 | ○ |
| 55 | 2.1 | 1.8 | 941 | 1053 | 12.3 | 125 | 3.0 | ◎ |
| 56 | 2.1 | 2.7 | 850 | 1051 | 12.0 | 96 | 2.1 | ○ |
| 57 | 2.1 | 1.8 | 1051 | 1056 | 12.7 | 130 | 2.0 | ◎ |
| 58 | 2.0 | 0.3 | 1180 | 1215 | 11.0 | 117 | 6.0 | ◎ |
| 59 | 2.0 | −0.1 | 1315 | 1491 | 10.1 | 82 | 8.1 | ○ |

◎: YP ≥ 900 MPa, TS ≥ 980 MPa, El ≥ 10%, $\lambda$ ≥ 90%, hydrogen embrittlement risk index ≤ 15%

○: TS ≥ 980 MPa, $\lambda$ ≥ 70%, hydrogen embrittlement risk index ≤ 15%

X: TS < 980 MPa or $\lambda$ < 70% or hydrogen embrittlement risk index >15%

Table 5 demonstrates as follows. Inventive steels (Steels Nos. 2 to 4, 6, 7, 10, 11, 14 to 16, 21 to 25, and 30) satisfying essential conditions specified in the present invention (the chemical compositional conditions and the essential metallographic conditions) each satisfactorily have a tensile strength TS of 980 MPa or more, a stretch flangeability (bore expansion ratio) $\lambda$ of 70% or more, and a hydrogen embrittlement risk index of 15% or less, indicating that they work as high-strength cold-rolled steel sheets each having both satisfactory workability and good hydrogen-embrittlement resistance.

In contrast, comparative steels (Steels Nos. 1, 5, 8, 9, 12, 13, 17, 20, 26 to 29, 31, and 32) each not satisfying at least one of the essential conditions specified in the present invention are each poor in at least one of the mechanical properties and hydrogen-embrittlement resistance. Steels Nos. 18 and 19 satisfy all the properties, but have a chemical composition [P] or [S] out of the range specified in the present invention, and are thereby treated as comparative steels.

Typically, Steel No. 1 has an insufficient number (number density) of fine precipitates each having an equivalent circle diameter of 1 to 10 nm and thereby has poor hydrogen embrittlement resistance, while excelling in tensile strength and stretch flangeability.

Steel No. 5 has an excessively high vanadium (V) content, thereby includes coarse precipitates each having an equivalent circle diameter of 20 nm or more in an excessively large number density. This steel therefore has poor stretch flangeability, while excelling in tensile strength and hydrogen embrittlement resistance.

Steel No. 8 has an excessively high silicon (Si) content and thereby shows an insufficient area percentage of martensite. For this reason, this steel has a low tensile strength and poor stretch flangeability, while excelling in hydrogen embrittlement resistance.

Steel No. 9 has an excessively low carbon (C) content and thereby shows an insufficient area percentage of martensite. For this reason, this steel has a low tensile strength and poor stretch flangeability, while excelling in hydrogen embrittlement resistance.

Steel No. 12 has an excessively high carbon (C) content and thereby includes coarse precipitates each having a size of 20 nm or more in an excessively large number density. For this reason, this steel has poor stretch flangeability, while excelling in tensile strength and hydrogen embrittlement resistance.

Steel No. 13 has an excessively low manganese (Mn) content and thereby has an insufficient area percentage of martensite. For this reason, this steel has a low tensile strength and poor stretch flangeability, while excelling in hydrogen embrittlement resistance.

Steel No. 17 has an excessively high Mn content and thereby includes retained austenite. For this reason, this steel has poor stretch flangeability and poor hydrogen embrittlement resistance, while excelling in tensile strength.

Steel No. 20 has an excessively high aluminum (Al) content and thereby has a low tensile strength and poor stretch flangeability, while excelling in hydrogen embrittlement resistance.

Steels Nos. 26 to 29, 31, and 32 have undergone annealing or tempering under conditions out of the recommended ranges, thereby do not satisfy at least one of the metallographic conditions specified in the present invention, and are poor or inferior in at least one of the properties.

Next, Table 6 demonstrates as follows. Recommended steels (Steels Nos. 34, 40, 42, 44, and 46) satisfying not only the essential conditions specified in the present invention but also the recommended metallographic condition (a) each satisfactorily have a tensile strength TS of 980 MPa or more, an elongation El of 10% or more, a stretch flangeability (bore expansion ratio) λ of 100% or more, and a hydrogen embrittlement risk index of 15% or less. This indicates that the recommended steel sheets will work as high-strength cold-rolled steel sheets having further higher workability than that of the inventive steels.

Table 7 demonstrates as follows. Recommended steels (Steels Nos. 48, 53, 55, 57, and 58) satisfying not only the essential conditions specified in the present invention but also the recommended metallographic condition (b) each satisfactorily have a yield strength of 900 MPa or more, a tensile strength TS of 980 MPa or more, an elongation El of 10% or more, a stretch flangeability (bore expansion ratio) λ of 90% or more, and a hydrogen embrittlement risk index of 15% or less. This indicates that the recommended steel sheets will work as high-strength cold-rolled steel sheets which have further more satisfactory workability than that of the inventive steels and excel also in crash safety.

2) Example 2

Steel Sheets Containing at Least One of Nb, Ti, and Zr

Respective steels, each having a specific chemical composition given in Table 8, were melted and formed into ingots each 120 mm thick. The ingots were hot-rolled to a thickness of 25 mm, and hot-rolled again to a thickness of 3 mm. The works were pickled, subsequently cold-rolled to a thickness of 1.2 mm, and thereby yielded steel sheets serving as specimens. Heat treatments under various conditions given in Tables 9 to 11 were applied to the steel sheets.

TABLE 8

| Steel | Chemical composition (% by mass) | | | | | | | | | | | | | | |
|---|---|---|---|---|---|---|---|---|---|---|---|---|---|---|---|
| type | C | Si | Mn | P | S | Al | Nb | Ti | Zr | V | Cr | Mo | Cu | Ni | B |
| A' | 0.09 | 1.22 | 2.02 | 0.010 | 0.002 | 0.021 | — | — | — | — | — | — | — | — | — |
| B' | 0.12 | 1.25 | 2.04 | 0.010 | 0.002 | 0.021 | 0.050 | — | — | — | — | — | — | — | — |
| C' | 0.12 | 1.20 | 2.06 | 0.010 | 0.002 | 0.021 | — | 0.050 | — | — | — | — | — | — | — |
| D' | 0.12 | 1.23 | 2.06 | 0.010 | 0.002 | 0.020 | 0.050 | 0.020 | — | — | — | — | — | — | — |
| E' | 0.12 | 1.21 | 2.09 | 0.010 | 0.002 | 0.021 | 0.300 | 0.500 | — | — | — | — | — | — | — |
| F' | 0.12 | 0.02 | 2.03 | 0.010 | 0.002 | 0.021 | 0.022 | 0.025 | — | — | — | — | — | — | — |
| G' | 0.12 | 1.86 | 2.03 | 0.010 | 0.002 | 0.020 | 0.012 | 0.023 | — | — | — | — | — | — | — |
| H' | 0.13 | 3.42 | 2.10 | 0.010 | 0.002 | 0.021 | 0.018 | 0.025 | — | — | — | — | — | — | — |
| I' | 0.01 | 1.25 | 2.02 | 0.010 | 0.002 | 0.021 | 0.019 | 0.024 | — | — | — | — | — | — | — |
| J' | 0.12 | 1.23 | 2.04 | 0.010 | 0.002 | 0.021 | 0.012 | 0.017 | — | — | — | — | — | — | — |
| K' | 0.23 | 1.23 | 2.01 | 0.010 | 0.002 | 0.021 | 0.200 | 0.200 | — | — | — | — | — | — | — |
| L' | 0.51 | 1.25 | 2.05 | 0.010 | 0.002 | 0.021 | 0.017 | 0.013 | — | — | — | — | — | — | — |
| M' | 0.12 | 1.24 | 0.10 | 0.010 | 0.002 | 0.020 | 0.052 | 0.038 | — | — | — | — | — | — | — |
| N' | 0.12 | 1.26 | 1.01 | 0.010 | 0.002 | 0.021 | 0.054 | 0.014 | — | — | — | — | — | — | — |
| O' | 0.11 | 1.22 | 1.50 | 0.010 | 0.002 | 0.020 | 0.040 | 0.032 | — | — | — | — | — | — | — |
| P' | 0.11 | 1.21 | 2.41 | 0.010 | 0.002 | 0.020 | 0.022 | 0.030 | — | — | — | — | — | — | — |
| Q' | 0.11 | 1.21 | 3.24 | 0.010 | 0.002 | 0.020 | 0.031 | 0.029 | — | — | — | — | — | — | — |
| R' | 0.11 | 1.20 | 2.04 | 0.300 | 0.002 | 0.021 | 0.041 | 0.023 | — | — | — | — | — | — | — |
| S' | 0.11 | 1.25 | 2.02 | 0.010 | 0.030 | 0.021 | 0.054 | 0.039 | — | — | — | — | — | — | — |
| T' | 0.12 | 1.23 | 2.06 | 0.010 | 0.002 | 0.522 | 0.034 | 0.019 | — | — | — | — | — | — | — |
| U' | 0.11 | 1.24 | 2.08 | 0.010 | 0.002 | 0.021 | 0.058 | 0.039 | — | 0.096 | — | — | — | — | — |
| V' | 0.11 | 1.24 | 2.01 | 0.010 | 0.002 | 0.020 | 0.028 | 0.021 | — | — | 1.00 | — | — | — | — |
| W' | 0.11 | 1.21 | 2.04 | 0.010 | 0.002 | 0.020 | 0.020 | 0.039 | — | — | — | 0.10 | — | — | — |
| X' | 0.11 | 1.25 | 2.05 | 0.010 | 0.002 | 0.021 | 0.052 | 0.030 | — | — | — | — | 0.20 | 0.10 | — |
| Y' | 0.11 | 1.23 | 2.01 | 0.010 | 0.002 | 0.021 | 0.040 | 0.031 | — | — | — | — | — | — | 0.0010 |
| Z' | 0.11 | 1.22 | 2.01 | 0.010 | 0.002 | 0.020 | — | — | 0.050 | — | — | — | — | — | — |
| ZA' | 0.11 | 1.23 | 2.02 | 0.010 | 0.002 | 0.020 | 0.020 | 0.020 | 0.030 | — | — | — | — | — | — |
| ZB' | 0.11 | 1.22 | 2.02 | 0.010 | 0.002 | 0.021 | 0.200 | 0.200 | 0.400 | — | — | — | — | — | — |

| Steel | Chemical composition (% by mass) | | | | Ac1 | Ac3 | (Ac1 + |
|---|---|---|---|---|---|---|---|
| type | Ca | Mg | N | REM | (° C.) | (° C.) | Ac3)/2 (° C.) |
| A' | — | — | 0.0042 | — | 737 | 904 | 820 |
| B' | — | — | 0.0046 | — | 738 | 896 | 817 |
| C' | — | — | 0.0046 | — | 736 | 893 | 815 |
| D' | — | — | 0.0045 | — | 737 | 895 | 816 |
| E' | — | — | 0.0043 | — | 736 | 894 | 815 |
| F' | 0.0009 | — | 0.0042 | — | 702 | 841 | 771 |
| G' | 0.0007 | — | 0.0044 | — | 755 | 923 | 839 |
| H' | 0.0005 | — | 0.0042 | — | 800 | 990 | 895 |
| I' | 0.0008 | — | 0.0042 | — | 738 | 946 | 842 |
| J' | 0.0007 | — | 0.0042 | — | 737 | 895 | 816 |
| K' | 0.0004 | — | 0.0045 | — | 737 | 874 | 806 |
| L' | 0.0004 | — | 0.0046 | — | 737 | 821 | 779 |
| M' | 0.0009 | — | 0.0045 | — | 758 | 895 | 827 |

TABLE 8-continued

| | | | | | | | |
|---|---|---|---|---|---|---|---|
| N' | 0.0006 | — | 0.0043 | — | 749 | 896 | 822 |
| O' | 0.0005 | — | 0.0040 | — | 742 | 897 | 820 |
| P' | 0.0008 | — | 0.0041 | — | 732 | 897 | 815 |
| Q' | 0.0008 | — | 0.0047 | — | 724 | 897 | 810 |
| R' | 0.0003 | — | 0.0044 | — | 736 | 896 | 816 |
| S' | 0.0004 | — | 0.0048 | — | 738 | 899 | 818 |
| T' | 0.0005 | — | 0.0041 | — | 737 | 895 | 816 |
| U' | 0.0007 | — | 0.0044 | — | 738 | 898 | 818 |
| V' | 0.0006 | — | 0.0042 | — | 738 | 898 | 818 |
| W' | 0.0005 | — | 0.0041 | | 736 | 900 | 818 |
| X' | — | 0.0005 | 0.0046 | — | 736 | 897 | 816 |
| Y' | — | — | 0.0042 | 0.0004 | 737 | 898 | 817 |
| Z' | — | — | 0.0044 | — | 737 | 898 | 818 |
| ZA' | — | — | 0.0042 | — | 736 | 898 | 817 |
| ZB' | — | — | 0.0041 | — | 737 | 865 | 801 |

TABLE 9

(Number 1)

| | Hot rolling conditions | | | Annealing conditions | | | | | | Tempering conditions | | |
|---|---|---|---|---|---|---|---|---|---|---|---|---|
| Heat treatment number | Heating temperature (° C.) | Finish rolling temperature (° C.) | Coiling temperature (° C.) | Heating temperature (° C.) | Holding time (sec) | First cooling rate (° C./sec) | First cooling end temperature (° C.) | Second cooling rate (° C./sec) | Second cooling end temperature (° C.) | Heating temperature (° C.) | Holding time (sec) | Parameter: Pg |
| a' | 1200 | 920 | 400 | 900 | 120 | 10 | 675 | 200 | 20 | 500 | 180 | $0.46 \times 10^{-5}$ |
| b' | 1200 | 920 | 600 | 900 | 120 | 10 | 675 | 200 | 20 | 500 | 180 | $0.46 \times 10^{-5}$ |
| c' | 1200 | 920 | 400 | 860 | 120 | 10 | 675 | 200 | 20 | 500 | 180 | $0.46 \times 10^{-5}$ |
| d' | 1200 | 920 | 400 | 900 | 120 | 0.2 | 675 | 200 | 20 | 500 | 180 | $0.46 \times 10^{-5}$ |
| e' | 1200 | 920 | 400 | 900 | 120 | 10 | 500 | 200 | 20 | 500 | 180 | $0.46 \times 10^{-5}$ |
| f' | 1200 | 920 | 400 | 900 | 120 | 10 | 675 | 20 | 350 | 500 | 180 | $0.46 \times 10^{-5}$ |
| h' | 1200 | 920 | 400 | 900 | 120 | 10 | 675 | 200 | 20 | 400 | 180 | $0.03 \times 10^{-5}$ |
| i' | 1200 | 920 | 400 | 900 | 120 | 10 | 675 | 200 | 20 | 500 | 600 | $1.52 \times 10^{-5}$ |
| j' | 1200 | 920 | 400 | 900 | 120 | 10 | 675 | 200 | 20 | 500 | 30 | $0.08 \times 10^{-5}$ |

(Heat treatment No. g' is a skipped number)

TABLE 10

(Number 2)

| | Hot rolling conditions | | | Annealing conditions | | | | | |
|---|---|---|---|---|---|---|---|---|---|
| Heat treatment number | Heating temperature (° C.) | Finish rolling temperature (° C.) | Coiling temperature (° C.) | Heating temperature (° C.) | Holding time (sec) | First cooling rate (° C./sec) | First cooling end temperature (° C.) | Second cooling rate (° C./sec) | Second cooling end temperature (° C.) |
| a'-1 | 1200 | 920 | 400 | 900 | 120 | 20 | 675 | 200 | 20 |
| b'-1 | 1200 | 920 | 400 | 900 | 120 | 20 | 675 | 200 | 20 |
| c'-1 | 1200 | 920 | 400 | 900 | 120 | 20 | 675 | 200 | 20 |
| d'-1 | 1200 | 920 | 400 | 900 | 120 | 20 | 675 | 200 | 20 |
| e'-1 | 1200 | 920 | 400 | 900 | 120 | 20 | 675 | 200 | 20 |

| | Tempering conditions | | | | | | |
|---|---|---|---|---|---|---|---|
| Heat treatment number | Average heating rate (° C./sec) | First-stage heating temperature (° C.) | First-stage holding time (sec) | Second-stage heating temperature (° C.) | Second-stage holding time (sec) | Parameter: P | Parameter: Pg |
| a'-1 | 20 | 350 | 60 | 500 | 180 | $6.9 \times 10^{-4}$ | $0.46 \times 10^{-5}$ |
| b'-1 | 20 | 200 | 60 | 500 | 180 | $6.9 \times 10^{-4}$ | $0.46 \times 10^{-5}$ |
| c'-1 | 20 | 450 | 60 | 500 | 180 | $6.9 \times 10^{-4}$ | $0.46 \times 10^{-5}$ |
| d'-1 | 20 | 350 | 60 | 400 | 180 | $1.1 \times 10^{-4}$ | $0.03 \times 10^{-5}$ |
| e'-1 | 20 | 350 | 60 | 600 | 180 | $2.9 \times 10^{-3}$ | $3.38 \times 10^{-5}$ |

TABLE 11

(Number 3)

| Heat treatment number | Hot rolling conditions: Heating temperature (° C.) | Finish rolling temperature (° C.) | Coiling temperature (° C.) | Annealing conditions: Heating temperature (° C.) | Holding time (sec) | First cooling rate (° C./sec) | First cooling end temperature (° C.) | Second cooling rate (° C./sec) | Second cooling end temperature (° C.) | Tempering conditions: Heating temperature (° C.) | Holding time (sec) | Parameter: Pg |
|---|---|---|---|---|---|---|---|---|---|---|---|---|
| a'-2 | 1200 | 920 | 400 | 900 | 120 | 20 | 675 | 200 | 20 | 600 | 15 | $0.28 \times 10^{-5}$ |
| b'-2 | 1200 | 920 | 400 | 900 | 120 | 20 | 675 | 200 | 20 | 600 | 1 | $0.02 \times 10^{-5}$ |
| c'-2 | 1200 | 920 | 400 | 900 | 120 | 20 | 675 | 200 | 20 | 600 | 180 | $3.38 \times 10^{-5}$ |
| d'-2 | 1200 | 920 | 400 | 900 | 120 | 20 | 675 | 200 | 20 | 700 | 15 | $1.39 \times 10^{-5}$ |
| f'-2 | 1200 | 920 | 400 | 900 | 120 | 20 | 675 | 200 | 20 | 600 | 5 | $0.09 \times 10^{-5}$ |

The respective steel sheets after the heat treatment were subjected to quantitative analyses of their structures according to the measuring methods described above. Specifically, the area percentage and hardness of martensite, the size and number (number density) of precipitates, and the average grain size of effective ferrite were measured on all the steel sheets after the heat treatments under the heat treatment conditions given in Tables 9 to 11. Independently, the size and number (number density) of cementite grains were measured only on the steel sheets undergone the heat treatments Nos. a'-1 to e'-1 given in Table 10. The dislocation density was measured only on the steel sheets undergone the heat treatments Nos. a'-2 to f'-2 given in Table 11.

Tensile strength TS, yield strength YP, elongation El, and stretch flangeability λ were measured on the respective steel sheets, for the evaluation of mechanical properties. In addition, hydrogen embrittlement risk index was measured on the steel sheets, for the evaluation of hydrogen-embrittlement resistance.

The tensile strength TS, the yield strength YP, and the elongation El were measured by preparing a specimen referred to as No. 5 specimen in JIS Z 2201, with its long axis oriented in a direction perpendicular to the rolling direction, and making measurements on the specimen in accordance with JIS Z 2241.

The stretch flangeability λ was determined by conducting a hole expanding test according to Iron and Steel Federation Specification JFST 1001 and measuring a bore expansion ratio as the stretch flangeability.

For the evaluation of the hydrogen embrittlement risk index, a flat specimen 1.2 mm thick was subjected to a slow strain rate test (SSRT: Slow Strain Rate Technique) at a strain rate (tensile speed) of $1\times10^{-4}$/s, to determine the hydrogen embrittlement risk index (%) defined by the following expression:

$$\text{Hydrogen embrittlement risk index (\%)}=100\times(1-E_1/E_0)$$

In the expression, $E_0$ represents the elongation before rupture of a steel specimen containing substantially no hydrogen; and $E_1$ represents the elongation before rupture of a steel specimen having been charged with hydrogen electrochemically in sulfuric acid. Hydrogen charging was carried out by immersing the steel specimen in a mixed solution of $H_2SO_4$ (0.5 mol/L) and KSCN (0.01 mol/L) and supplying a constant current (100 A/m$^2$) at room temperature.

A steel sheet having a hydrogen embrittlement risk index of more than 15% may undergo hydrogen embrittlement during use. In the present invention, therefore, steel sheets having hydrogen embrittlement risk index of 15% or less were evaluated to have satisfactory hydrogen embrittlement resistance.

Measured data of the mechanical properties and hydrogen-embrittlement resistance are shown in Tables 12 to 14.

TABLE 12

(Number 1)

| Steel No. | Steel type | Heat treatment number | Pf | Martensite area percentage VM (%) | Ferrite area percentage VF (%) | Area percentage of other structures (%) | Number density of precipitates of 1-10 nm (number/μm$^2$) | Number density of Nb, Ti, Zr-containing precipitates of 20 nm or more (number/μm$^2$) | Average grain size of effective ferrite (μm) | TS (MPa) | λ (%) | Hydrogen embrittlement risk index (%) | Evaluation |
|---|---|---|---|---|---|---|---|---|---|---|---|---|---|
| 60 | A' | a' | — | 94 | 6 | 0 | 0 | 0.0 | 8 | 1023 | 76 | 18.9 | X |
| 61 | B' | a' | 0.0013 | 91 | 9 | 0 | 25 | 0.7 | 3 | 1025 | 76 | 10.0 | ○ |
| 62 | C' | a' | 0.0013 | 92 | 8 | 0 | 77 | 0.7 | 2 | 1042 | 79 | 8.1 | ○ |
| 63 | D' | a' | 0.0013 | 94 | 6 | 0 | 136 | 7.3 | 3 | 1064 | 73 | 6.1 | ○ |
| 64 | E' | a' | 0.2010 | 93 | 7 | 0 | 267 | 21.0 | 3 | 700 | 32 | 2.0 | X |
| 65 | F' | a' | 0.0013 | 93 | 7 | 0 | 142 | 0.8 | 3 | 1011 | 82 | 6.4 | ○ |
| 66 | G' | a' | 0.0013 | 93 | 7 | 0 | 134 | 0.8 | 3 | 1041 | 82 | 6.2 | ○ |
| 67 | H' | a' | 0.0012 | 41 | 59 | 0 | 160 | 0.6 | 3 | 908 | 61 | 6.0 | X |
| 68 | I' | a' | 0.0222 | 14 | 86 | 0 | 163 | 0.6 | 3 | 602 | 81 | 7.0 | X |
| 69 | J' | a' | 0.0013 | 94 | 6 | 0 | 130 | 0.6 | 3 | 1030 | 91 | 7.0 | ○ |
| 70 | K' | a' | 0.0012 | 100 | 0 | 0 | 139 | 4.3 | 3 | 1201 | 97 | 6.1 | ○ |
| 71 | L' | a' | 0.0003 | 100 | 0 | 0 | 125 | 21.1 | 3 | 1304 | 39 | 32.0 | X |
| 72 | M' | a' | 0.0014 | 41 | 59 | 0 | 128 | 0.7 | 3 | 704 | 63 | 6.1 | X |
| 73 | N' | a' | 0.0013 | 71 | 29 | 0 | 150 | 0.7 | 3 | 982 | 71 | 6.9 | ○ |
| 74 | O' | a' | 0.0015 | 81 | 20 | 0 | 135 | 0.6 | 3 | 1004 | 82 | 6.9 | ○ |
| 75 | P' | a' | 0.0014 | 100 | 0 | 0 | 140 | 0.7 | 3 | 1042 | 89 | 6.9 | ○ |
| 76 | Q' | a' | 0.0015 | 83 | 0 | 17 | 165 | 0.7 | 3 | 1101 | 31 | 40.5 | X |
| 77 | R' | a' | 0.0015 | 91 | 9 | 0 | 151 | 0.8 | 3 | 1022 | 86 | 6.5 | ○ |

TABLE 12-continued (Number 1)

| Steel No. | Steel type | Heat treatment number | Pf | Martensite area percentage VM (%) | Ferrite area percentage VF (%) | Area percentage of other structures (%) | Number density of precipitates of 1-10 nm (number/μm$^2$) | Number density of Nb, Ti, Zr-containing precipitates of 20 nm or more (number/μm$^2$) | Average grain size of effective ferrite (μm) | TS (MPa) | λ (%) | Hydrogen embrittlement risk index (%) | Evaluation |
|---|---|---|---|---|---|---|---|---|---|---|---|---|---|
| 78 | S' | a' | 0.0015 | 93 | 7 | 0 | 140 | 0.7 | 3 | 1023 | 89 | 6.9 | ○ |
| 79 | T' | a' | 0.0013 | 44 | 56 | 0 | 133 | 0.6 | 3 | 808 | 54 | 6.9 | X |
| 80 | U' | a' | 0.0016 | 100 | 0 | 0 | 213 | 0.5 | 3 | 1059 | 99 | 3.3 | ○ |
| 81 | V' | a' | 0.0014 | 100 | 0 | 0 | 216 | 0.7 | 3 | 1055 | 99 | 3.5 | ○ |
| 82 | W' | a' | 0.0015 | 100 | 0 | 0 | 147 | 0.7 | 3 | 1057 | 97 | 2.2 | ○ |
| 83 | X' | a' | 0.0015 | 100 | 0 | 0 | 163 | 0.7 | 3 | 1029 | 95 | 6.5 | ○ |
| 84 | Y' | a' | 0.0015 | 100 | 0 | 0 | 127 | 0.5 | 3 | 1023 | 95 | 6.1 | ○ |
| 85 | J' | b' | 0.0013 | 94 | 6 | 0 | 134 | 14.2 | 3 | 1003 | 57 | 6.9 | X |
| 86 | J' | c' | 0.0007 | 73 | 27 | 0 | 11 | 0.7 | 3 | 803 | 67 | 6.2 | X |
| 87 | J' | d' | 0.0013 | 31 | 69 | 0 | 158 | 0.8 | 3 | 710 | 67 | 6.6 | X |
| 88 | J' | e' | 0.0013 | 43 | 15 | 42 | 155 | 0.5 | 3 | 702 | 42 | 6.7 | X |
| 89 | J' | f' | 0.0013 | 100 | 0 | 0 | 138 | 0.5 | 3 | 1211 | 99 | 6.9 | ○ |
| 90 | J' | g' | 0.0013 | 93 | 7 | 0 | 10 | 0.0 | 3 | 1217 | 78 | 20.6 | X |
| 91 | J' | h' | 0.0013 | 93 | 7 | 0 | 82 | 18.7 | 3 | 1003 | 39 | 12.6 | X |
| 92 | J' | j' | 0.0090 | 93 | 7 | 0 | 65 | 0.2 | 3 | 1305 | 80 | 9.0 | ○ |
| 93 | K' | j' | 0.0013 | 100 | 0 | 0 | 120 | 0.3 | 3 | 1521 | 72 | 10.0 | ○ |
| 119 | Z' | a' | 0.0013 | 91 | 9 | 0 | 22 | 0.7 | 3 | 1031 | 76 | 9.8 | ○ |
| 120 | ZA' | a' | 0.0013 | 94 | 6 | 0 | 129 | 7.2 | 3 | 1083 | 91 | 6.4 | ○ |
| 121 | ZB' | a' | 0.0931 | 93 | 7 | 0 | 254 | 22.5 | 3 | 715 | 38 | 1.9 | X |

○: TS ≥ 980 MPa, λ ≥ 70%, hydrogen embrittlement risk index ≤ 15%

X: TS < 980 MPa or λ < 70% or hydrogen embrittlement risk index >15%

TABLE 13

(Number 2)

| Steel No. | Steel type | Heat treatment number | Martensite area percentage VM (%) | Ferrite area percentage VF (%) | Area percentage of other structures (%) | Hardness of martensite HvM | Number density of precipitates of 1-10 nm (number/μm$^2$) | Number density of Nb, Ti, Zr-containing precipitates of 20 nm or more (number/μm$^2$) | Average grain size of effective ferrite (μm) |
|---|---|---|---|---|---|---|---|---|---|
| 92' | J' | a' | 94 | 6 | 0 | 332 | 130 | 0.6 | 3 |
| 93' | J' | a'-1 | 94 | 6 | 0 | 330 | 154 | 0.5 | 3 |
| 94 | J' | b'-1 | 94 | 6 | 0 | 332 | 139 | 0.6 | 3 |
| 95 | J' | c'-1 | 94 | 6 | 0 | 338 | 141 | 0.7 | 3 |
| 96 | J' | d'-1 | 94 | 6 | 0 | 394 | 0 | 0.0 | 3 |
| 97 | J' | e'-1 | 94 | 6 | 0 | 295 | 94 | 14.2 | 3 |
| 98 | G' | a' | 93 | 7 | 0 | 351 | 134 | 0.8 | 3 |
| 99 | G' | a'-1 | 93 | 7 | 0 | 354 | 128 | 1.1 | 3 |
| 100 | O' | a | 81 | 20 | 0 | 362 | 135 | 0.6 | 3 |
| 101 | O' | a'-1 | 81 | 20 | 0 | 359 | 165 | 0.7 | 3 |
| 102 | V' | a' | 100 | 0 | 0 | 368 | 213 | 0.5 | 3 |
| 103 | V' | a'-1 | 100 | 0 | 0 | 374 | 235 | 0.7 | 3 |
| 104 | W' | a' | 100 | 0 | 0 | 359 | 147 | 0.7 | 3 |
| 105 | W' | a'-1 | 100 | 0 | 0 | 352 | 231 | 0.8 | 3 |
| 122 | ZA' | a' | 93 | 7 | 0 | 361 | 125 | 7.4 | 3 |
| 123 | ZA' | a'-1 | 93 | 7 | 0 | 352 | 133 | 7.3 | 3 |

| Steel No. | Number density of cementite grains of 0.1 μm or more (number/μm$^2$) | Number density of cementite grains of 0.02 μm or more but less than 0.1 μm (number/μm$^2$) | TS (MPa) | El (%) | λ (%) | Hydrogen embrittlement risk index (%) | Evaluation |
|---|---|---|---|---|---|---|---|
| 92' | 3.4 | 15.9 | 1030 | 11.5 | 91 | 7.0 | ◎ |
| 93' | 1.2 | 15.8 | 1029 | 11.5 | 112 | 7.0 | ◎ |
| 94 | 6.3 | 15.4 | 1026 | 12.0 | 83 | 7.0 | ○ |
| 95 | 5.1 | 15.2 | 1027 | 11.6 | 63 | 7.0 | X |
| 96 | 1.4 | 8.0 | 1149 | 8.1 | 92 | 24.0 | X |
| 97 | 7.2 | 28.7 | 921 | 14.5 | 75 | 3.0 | X |
| 98 | 5.4 | 16.0 | 1041 | 11.7 | 82 | 6.2 | ○ |
| 99 | 1.7 | 15.9 | 1042 | 12.0 | 101 | 6.0 | ◎ |
| 100 | 5.2 | 15.5 | 1004 | 12.4 | 82 | 6.9 | ○ |
| 101 | 1.8 | 15.1 | 1010 | 12.7 | 103 | 6.0 | ◎ |
| 102 | 5.1 | 15.8 | 1055 | 12.1 | 99 | 3.5 | ◎ |

TABLE 13-continued (Number 2)

| | | | | | | | |
|---|---|---|---|---|---|---|---|
| 103 | 1.9 | 15.4 | 1054 | 13.0 | 117 | 3.0 | ◎ |
| 104 | 5.1 | 15.6 | 1057 | 11.7 | 97 | 2.2 | ◎ |
| 105 | 1.7 | 15.2 | 1060 | 11.8 | 116 | 2.0 | ◎ |
| 122 | 3.9 | 15.7 | 1079 | 11.3 | 91 | 6.6 | ◎ |
| 123 | 1.3 | 15.8 | 1081 | 11.9 | 102 | 6.6 | ◎ |

◎: TS ≥ 980 MPa, El ≥ 10%, λ ≥ 90%, hydrogen embrittlement risk index ≤ 15%
○: TS ≥ 980 MPa, λ ≥ 70%, hydrogen embrittlement risk index ≤ 15%
X: TS < 980 MPa or λ < 70% or hydrogen embrittlement risk index >15%

TABLE 14

(Number 3)

| Steel No. | Steel type | Heat treatment number | Martensite area percentage VM (%) | Ferrite area percentage VF (%) | Area percentage of other structures (%) | Number density of precipitates of 1-10 nm (number/μm$^2$) | Number density of Nb, Ti, Zr-containing precipitates of 20 nm or more (number/μm$^2$) | Average grain size of effective ferrite (μm) | Dislocation density ρ ($10^{15}$ m$^{-2}$) |
|---|---|---|---|---|---|---|---|---|---|
| 106 | J' | a' | 94 | 6 | 0 | 130 | 0.6 | 3 | 0.5 |
| 107 | J' | a'-2 | 92 | 8 | 0 | 141 | 0.3 | 3 | 1.6 |
| 108 | J' | b'-2 | 92 | 8 | 0 | 0 | 0.0 | 3 | 1200 |
| 109 | J' | c'-2 | 91 | 9 | 0 | 143 | 21.4 | 3 | 0.4 |
| 110 | J' | d'-2 | 92 | 8 | 0 | 146 | 46.6 | 3 | 0.2 |
| 111 | G' | a' | 93 | 7 | 0 | 167 | 0.8 | 3 | 0.5 |
| 112 | G' | a'-2 | 91 | 9 | 0 | 182 | 0.4 | 3 | 1.8 |
| 113 | V' | a | 100 | 0 | 0 | 213 | 0.5 | 3 | 0.6 |
| 114 | V' | a'-2 | 100 | 0 | 0 | 244 | 0.4 | 3 | 1.8 |
| 115 | W' | a' | 100 | 0 | 0 | 174 | 0.7 | 3 | 0.6 |
| 116 | W' | a'-2 | 100 | 0 | 0 | 175 | 0.5 | 3 | 1.8 |
| 117 | J' | f'-2 | 92 | 8 | 0 | 80 | 0.2 | 3 | 6.0 |
| 118 | K' | f'-2 | 100 | 0 | 0 | 120 | 0.9 | 2.5 | 7.1 |
| 124 | ZA' | a' | 93 | 7 | 0 | 125 | 7.4 | 3 | 0.6 |
| 125 | ZA' | a'-2 | 93 | 7 | 0 | 133 | 7.3 | 3 | 1.5 |

| Steel No. | Si equivalent (% by mass) | 4.0-5.3 × $10^{-8}$ $\sqrt{\rho}$ ($m^{-1}$) | YP (MPa) | TS (MPa) | El (%) | λ (%) | Hydrogen embrittlement risk index (%) | Evaluation |
|---|---|---|---|---|---|---|---|---|
| 106 | 2.1 | 2.8 | 840 | 1030 | 12.0 | 91 | 7.0 | ○ |
| 107 | 2.1 | 1.9 | 985 | 1029 | 13.0 | 123 | 5.0 | ◎ |
| 108 | 2.1 | 0.4 | 1321 | 1382 | 6.3 | 82 | 32.0 | X |
| 109 | 2.1 | 2.9 | 829 | 969 | 14.1 | 64 | 4.0 | X |
| 110 | 2.1 | 3.3 | 787 | 854 | 15.6 | 90 | 2.0 | X |
| 111 | 2.7 | 2.8 | 890 | 1041 | 12.0 | 82 | 6.2 | ○ |
| 112 | 2.7 | 1.8 | 990 | 1041 | 12.0 | 100 | 6.0 | ◎ |
| 113 | 2.0 | 2.7 | 850 | 1055 | 12.1 | 99 | 3.5 | ○ |
| 114 | 2.0 | 1.8 | 949 | 1057 | 12.5 | 129 | 3.0 | ◎ |
| 115 | 2.4 | 2.7 | 850 | 1057 | 12.0 | 97 | 2.2 | ○ |
| 116 | 2.4 | 1.8 | 1059 | 1051 | 12.3 | 126 | 2.0 | ◎ |
| 117 | 2.1 | −0.1 | 1203 | 1235 | 12.1 | 108 | 6.9 | ○ |
| 118 | 2.1 | −0.5 | 1381 | 1495 | 10.0 | 90 | 9.0 | ○ |
| 124 | 2.0 | 2.7 | 855 | 1079 | 12.5 | 91 | 6.6 | ○ |
| 125 | 2.0 | 1.9 | 993 | 1081 | 13.0 | 115 | 4.9 | ◎ |

◎: YP ≥ 900 MPa, TS ≥ 980 MPa, El ≥ 10%, λ ≥ 90%, hydrogen embrittlement risk index ≤ 15%
○: TS ≥ 980 MPa, λ ≥ 70%, hydrogen embrittlement risk index ≤ 15%
X: TS < 980 MPa or λ < 70% or hydrogen embrittlement risk index > 15%

Table 12 demonstrates as follows. Inventive steels (Steels Nos. 61 to 63, 65, 66, 69, 70, 73 to 75, 80 to 84, 89, 92, 93, 119, and 120) satisfying the essential conditions specified in the present invention (the chemical compositional conditions and the essential metallographic conditions) each have a tensile strength TS of 980 MPa or more, a stretch flangeability (bore expansion ratio) λ of 70% or more, and a hydrogen embrittlement risk index of 15% or less, indicating that they have both satisfactory workability and good hydrogen-embrittlement resistance.

In contrast, comparative steels (Steels Nos. 60, 64, 67, 68, 71, 72, 76, 79, 85 to 88, 90, 91, and 121) not satisfying at least one of the essential conditions specified in the present invention are inferior in any of the mechanical properties and hydrogen-embrittlement resistance. In this connection, Steels Nos. 77 and 78 satisfy all the properties, but have a chemical composition [P] or [S] out of the range specified in the present invention, and are thereby treated as comparative steels.

Typically, Steel No. 60 contains none of Nb, Ti, and Zr, thereby includes no fine precipitate having an equivalent circle diameter of 1 to 10 nm, and have poor hydrogen embrittlement resistance, while excelling in tensile strength and stretch flangeability.

Steels Nos. 64 and 121 have an excessively high content of at least one of Nb, Ti, and Zr, thereby include coarse precipitates each having an equivalent circle diameter of 20 nm or more in an excessively large number density, and have a low tensile strength and poor stretch flangeability, while excelling in hydrogen embrittlement resistance.

Steel No. 67 has an excessively high Si content, thereby has an insufficient area percentage of martensite, and has a low tensile strength and poor stretch flangeability, while excelling in hydrogen embrittlement resistance.

Steel No. 68 has an excessively low carbon content, thereby has an insufficient area percentage of martensite, and shows a low tensile strength, while excelling in stretch flangeability and hydrogen embrittlement resistance.

Steel No. 71 has an excessively high carbon content, thereby includes coarse precipitates having a size of 20 nm or more in an excessively large number density, and shows poor stretch flangeability, while excelling in tensile strength and hydrogen embrittlement resistance.

Steel No. 72 has an excessively low Mn content, thereby has an insufficient area percentage of martensite, and has a low tensile strength and poor stretch flangeability, while excelling in hydrogen embrittlement resistance.

Steel No. 76 has an excessively high Mn content, thereby includes retained austenite, and has poor stretch flangeability and poor hydrogen embrittlement resistance, while excelling in tensile strength.

Steel No. 79 has an excessively high Al content, thereby shows an insufficient area percentage of martensite, and has a low tensile strength and poor stretch flangeability, while excelling in hydrogen embrittlement resistance.

Steels Nos. 85 to 88, 90, and 91 have undergone annealing or tempering under conditions out of the recommended ranges, thereby do not satisfy at least one of the metallographic conditions specified in the present invention, and are poor or inferior in at least one of the properties.

Next, Table 13 demonstrates as follows. Recommended steels (Steels Nos. 93', 99, 101, 103, 105, and 123) satisfying not only the essential conditions specified in the present invention but also the recommended metallographic condition (a) each satisfactorily have a tensile strength TS of 980 MPa or more, an elongation El of 10% or more, a stretch flangeability (bore expansion ratio) λ of 100% or more, and a hydrogen embrittlement risk index of 15% or less. This indicates that the recommended steel sheets will work as high-strength cold-rolled steel sheets having further higher workability than that of the inventive steels.

Table 14 demonstrates as follows. Recommended steels (Steels Nos. 107, 112, 114, 116, and 125) satisfying not only the essential conditions specified in the present invention but also the recommended metallographic condition (b) each satisfactorily have a yield strength of 900 MPa or more, a tensile strength TS of 980 MPa or more, an elongation El of 10% or more, a stretch flangeability (bore expansion ratio) λ of 90% or more, and a hydrogen embrittlement risk index of 15% or less. This indicates that the recommended steel sheets will work as high-strength cold-rolled steel sheets which have further more satisfactory workability than that of the inventive steels and excel also in crash safety.

While the present invention has been described in detail with reference to the specific embodiments thereof it is obvious to those skilled in the art that various changes and modifications can be made in the invention without departing from the spirit and scope of the invention. The present application is based on Japanese Patent Application No. 2009-079775 filed on Mar. 27, 2009, the entire contents of which are incorporated herein by reference.

The invention claimed is:

1. A cold-rolled steel sheet: comprising: iron (Fe), carbon (C) in a content of 0.05 to 0.30 percent by mass, silicon (Si) in a content of 3.0 percent by mass or less, manganese (Mn) in a content of more than 0.1 percent by mass but 2.8 percent by mass or less, phosphorus (P) in a content of 0.1 percent by mass or less, sulfur (S) in a content of 0.005 percent by mass or less, nitrogen (N) in a content of 0.01 percent by mass or less, aluminum (A1) in a content of 0.01 to 0.50 percent by mass, and further comprising-vanadium (V) in a content of 0.001 to 1.00 percent by mass, or at least one element selected from the group consisting of niobium (Nb), titanium (Ti), and zirconium (Zr) in a total content of 0.01 percent by mass or more, if the at least one element is present, following Expression 1 is satisfied:

$$[\%\,C]-[\%\,Nb]/92.9\times12-[\%\,Ti]/47.9\times12-[\%\,Zr]/91.2\times12>0.03 \quad \text{(Expression 1)}$$

where [% C], [% Nb], [% Ti], and [% Zr] represent contents of percent by mass of C, Nb, Ti, and Zr, respectively, wherein the cold-rolled steel sheet comprises tempered martensite in a content of 50 percent by area or more with a remainder comprising ferrite, the tempered martensite has a number density of precipitates having an equivalent circle diameter of 1 to 10 nm of 20 or more per 1 $\mu m^2$ and a number density of precipitates comprising V or at least one element selected from the group consisting of Nb, Ti, and Zr and having an equivalent circle diameter of 20 nm or more of 10 or less per 1 $\mu m^2$, and the tempered martensite has a number density of cementite grains having an equivalent circle diameter of 0.02 μm or more but less than 0.1 μm of 10 or more per 1 $\mu m^2$, and a number density of cementite grains having an equivalent circle diameter of 0.1 μm or more of 3 or less per 1 $\mu m^2$.

2. The cold-rolled steel sheet according to claim 1, wherein the cold-rolled steel sheet comprises at least one element selected from the group consisting of Nb, Ti, and Zr in a total content of 0.01 percent by mass or more so as to satisfy Expression 1, and ferrite grains each surrounded by a high-angle boundary with a difference in orientation between two grains of 15° or more have an average grain size of 5 μm or less.

3. The cold-rolled steel sheet according to claim 2, wherein the cold-rolled steel sheet comprises V in a content of 0.001 to 0.20 percent by mass, and the tempered martensite has a number density of precipitates comprising V and having an equivalent circle diameter of 20 nm or more of 10 or less per 1 $\mu m^2$.

4. The cold-rolled steel sheet according to claim 1, further comprising at least one element selected from the group consisting of:

chromium (Cr) in a content of 0.01 to 1.0 percent by mass, molybdenum (Mo) in a content of 0.01 to 1.0 percent by mass, copper (Cu) in a content of 0.05 to 1.0 percent by mass, and nickel (Ni) in a content of 0.05 to 1.0 percent by mass.

5. The cold-rolled steel sheet according to claim 1, further comprising boron (B) in a content of 0.0001 to 0.0050 percent by mass.

6. The cold-rolled steel sheet according to claim 1, further comprising at least one element selected from the group consisting of:

calcium (Ca) in a content of 0.0005 to 0.01 percent by mass, magnesium (Mg) in a content of 0.0005 to 0.01 percent by mass, and a rare-earth element (REM) in a content of 0.0004 to 0.01 percent by mass.

7. A cold-rolled steel sheet comprising:

iron (Fe), carbon (C) in a content of 0.05 to 0.30 percent by mass, silicon (Si) in a content of 3.0 percent by mass or less, manganese (Mn) in a content of more than 0.1 percent by mass but 2.8 percent by mass or less, phosphorus (P) in a content of 0.1 percent by mass or less, sulfur (S) in a content of 0.005 percent by mass or less, nitrogen (N) in a content of 0.01 percent by mass or less, aluminum (A1) in a content of 0.01 to 0.50 percent by mass, and further comprising vanadium (V) in a content of 0.001 to 1.00 percent by mass, or at least one element selected from the group consisting of niobium (Nb), titanium (Ti), and zirconium (Zr) in a total content of 0.01 percent by mass or more, if the at least one element is present, following Expression 1 is satisfied:

$$[\%\ C]-[\%\ Nb]/92.9\times12-[\%\ Ti]/47.9\times12-[\%\ Zr]/91.2\times12>0.03 \quad \text{(Expression 1)}$$

where [% C], [% Nb], [% Ti], and [% Zr] represent contents of percent by mass of C, Nb, Ti, and Zr, respectively, wherein the cold-rolled steel sheet comprises tempered martensite in a content of 50 percent by area or more with a remainder comprising ferrite, the tempered martensite has a number density of precipitates having an equivalent circle diameter of 1 to 10 nm of 20 or more per 1 $\mu m^2$, and a number density of precipitates comprising V or at least one element selected from the group consisting of Nb, Ti, and Zr and having an equivalent circle diameter of 20 nm or more of 10 or less per 1 $\mu m^2$, the entire cold-rolled steel sheet has a dislocation density of $1\times10^{15}$ to $1\times10^{16}$ $m^{-2}$, and the cold-rolled steel sheet has a Si equivalent being defined according to Expression 2 and satisfying Expression 3:

$$[\text{Si equivalent}]=[\%\ Si]+0.361\%\ Mn]+7.561\%\ P]+0.15\ [\%\ Mo]+0.361\%\ Cr]+0.43\ [\%\ Cu] \quad \text{(Expression 2)}$$

where [% Si], [% Mn], [% P], [% Mo], [% Cr], and [% Cu] represent contents of percent by mass of Si, Mn, P, Mo, Cr, and Cu, respectively, $$[\text{Si equivalent}]\geq4.0-5.3\times10^{-8}\sqrt{[\text{dislocationdensity}]} \quad \text{(Expression 3).}$$

* * * * *